US009598264B2

(12) United States Patent
Mizuno et al.

(10) Patent No.: US 9,598,264 B2
(45) Date of Patent: Mar. 21, 2017

(54) ELEVATOR SAFETY DEVICE AND ELEVATOR SAFETY DEVICE MOUNTING METHOD

(75) Inventors: Sachiomi Mizuno, Tokyo (JP); Hideki Nakamura, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 127 days.

(21) Appl. No.: 14/345,783

(22) PCT Filed: Dec. 7, 2011

(86) PCT No.: PCT/JP2011/078270

§ 371 (c)(1),
(2), (4) Date: Mar. 19, 2014

(87) PCT Pub. No.: WO2013/084312

PCT Pub. Date: Jun. 13, 2013

(65) Prior Publication Data

US 2014/0216857 A1 Aug. 7, 2014

(51) Int. Cl.

| | |
|---|---|
| ***B66B 5/18*** | (2006.01) |
| ***B66B 5/22*** | (2006.01) |
| ***B66B 7/04*** | (2006.01) |

(52) U.S. Cl.

CPC ..... *B66B 5/18* (2013.01); *B66B 5/22* (2013.01); *B66B 7/04* (2013.01)

(58) Field of Classification Search

CPC ..... B66B 5/18; B66B 5/22; B66B 7/04
(Continued)

(56) References Cited

U.S. PATENT DOCUMENTS 1,789,008 A * 1/1931 Lindquist ..... B66B 7/068 187/265
1,948,746 A * 2/1934 Dunlop ..... B66B 5/08 187/375

(Continued)

FOREIGN PATENT DOCUMENTS

| | | |
|---|---|---|
| JP | 7 17332 | 3/1995 |
| JP | 3099659 | 10/2000 |

(Continued)

OTHER PUBLICATIONS

International Search Report Issued Apr. 10, 2012 in PCT/JP11/078270 Filed Dec. 7, 2011.

*Primary Examiner* — Michael Riegelman
(74) *Attorney, Agent, or Firm* — Oblon, McClelland, Maier & Neustadt, L.L.P.

(57) ABSTRACT

A safety device main body that is inserted inside a lower frame of a car frame includes a braking member. A guiding apparatus includes a guide shoe that is displaceable inside the safety device main body between a guided position that is guided by a guide rail and a retracted position that is removed from the guided position. The guide shoe is disposed in the guided position when the braking member is separated from the guide rail. An actuating apparatus displaces the guide shoe toward the retracted position while displacing the braking member in a direction of contact with the guide rail. The safety device main body, the guiding apparatus, and the actuating apparatus are supported together by a supporting body. The supporting body is mounted onto the lower frame from below using a mounting aperture that is previously disposed on the lower frame.

6 Claims, 17 Drawing Sheets

(58) Field of Classification Search
USPC ..... 187/376
See application file for complete search history.

(56) References Cited

U.S. PATENT DOCUMENTS

| | | | | | |
|---|---|---|---|---|---|
| 3,509,970 | A * | 5/1970 | Gabler | B66B 5/18 | 187/376 |
| 5,096,020 | A * | 3/1992 | Korhonen | B66B 5/22 | 187/359 |
| 5,159,995 | A | 11/1992 | Sissala et al. | | |
| 5,363,942 | A * | 11/1994 | Osada | B66B 5/22 | 187/376 |
| 5,964,320 | A * | 10/1999 | Kato | B66B 5/22 | 187/375 |
| 6,425,462 | B1 * | 7/2002 | Tran | B66B 5/18 | 187/367 |
| 2007/0181378 | A1 * | 8/2007 | Kigawa | B66B 5/06 | 187/376 |
| 2014/0151159 | A1 * | 6/2014 | Mizuno | B66B 5/22 | 187/359 |

FOREIGN PATENT DOCUMENTS

| | | |
|---|---|---|
| JP | 2001 80840 | 3/2001 |
| JP | 2002 87727 | 3/2002 |
| JP | 2007 238225 | 9/2007 |
| JP | 2008 162767 | 7/2008 |
| JP | 2009 113914 | 5/2009 |
| JP | 2009 220898 | 10/2009 |

* cited by examiner

ELEVATOR SAFETY DEVICE AND ELEVATOR SAFETY DEVICE MOUNTING METHOD

TECHNICAL FIELD

The present invention relates to an elevator safety device that is mounted onto a car to apply a braking force to the car, and to an elevator safety device mounting method for mounting the safety device onto the car.

BACKGROUND ART

Conventionally, in order to make safety devices mountable to cars, elevator safety devices have been proposed in which the safety devices are mounted onto lower beams of cars by means of mounting adapters (Patent Literature 1 and 2).

CITATION LIST

Patent Literature

[Patent Literature 1]
Japanese Patent Laid-Open No. 2008-162767 (Gazette)
[Patent Literature 2]
Japanese Patent Laid-Open No. 2009-220898 (Gazette)

SUMMARY OF THE INVENTION

Problem to be Solved by the Invention

In hydraulic direct-coupled plunger-type elevators (elevators in which a car is coupled directly to a hydraulic plunger, and the car moves vertically by vertical movement of the plunger), for example, sometimes safety devices are not mounted onto the car. Consequently, when hydraulic direct-coupled plunger-type elevators are remodeled into suspension elevators in which a car is suspended by ropes or belts, for example, it is necessary to mount safety devices onto the car.

However, because the safety devices that are shown in Patent Literature 1 and 2 are mounted below mounting adapters that are mounted onto a lower surface of a lower beam of the car, the safety devices protrude downward from the car significantly, and if there is not sufficient room in the pit of the hoistway, the safety devices cannot be mounted onto the car.

When mounting the safety devices that are shown in Patent Literature 1 and 2 onto a hydraulic direct-coupled plunger-type elevator car, the lower beam, etc., of the car must be transported to a factory to perform machining to form bolt apertures, etc., on the lower beam for mounting the mounting adapters, making the work of mounting the safety devices onto the car very time-consuming. Because of that, the duration of the remodeling work is lengthened, prolonging down time during which the elevator cannot be used.

The present invention aims to solve the above problems and an object of the present invention is to provide an elevator safety device that can be prevented from protruding significantly vertically from a car, and that can be easily mounted onto the car, and to provide an elevator safety device mounting method.

Means for Solving the Problem

In order to achieve the above object, according to one aspect of the present invention, there is provided an elevator safety device that is mounted onto a car that includes a cage and a car frame that surrounds the cage, the car being moved along a guide rail, and the elevator safety device applying a braking force to the car, wherein the elevator safety device includes: a safety device main body that includes a braking member that can contact with and separate from the guide rail, and that is inserted inside a lower frame of the car frame so as to apply a braking force to the car by placing the braking member in contact with the guide rail; a guiding apparatus that includes a guide shoe that is displaceable inside the safety device main body between a guided position that is guided by the guide rail and a retracted position that is removed from the guided position, the guide shoe being disposed in the guided position when the braking member is separated from the guide rail; an actuating apparatus that displaces the guide shoe toward the retracted position while displacing the braking member in a direction of contact with the guide rail; and a supporting body that is mounted onto the lower frame from below using a mounting aperture that is previously disposed on the lower frame so as to support the safety device main body, the guiding apparatus, and the actuating apparatus together.

According to another aspect of the present invention, there is provided an elevator safety device mounting method including: a unit producing step in which a safety unit is produced by mounting a safety device main body, a guiding apparatus, and an actuating apparatus onto a supporting body together; a guide shoe mounting plate removing step in which an existing guide shoe mounting plate that is mounted using a mounting aperture that is previously disposed on a lower frame of a car is removed from the lower frame; and a unit mounting step in which the supporting body is mounted onto the lower frame from below using the mounting aperture that is previously disposed on the lower frame after the guide shoe mounting plate removing step while inserting the safety unit inside the lower frame from below.

Effects of the Invention

According to an elevator safety device and an elevator safety device mounting method according to the present invention, the safety device can be prevented from protruding significantly vertically from a car, and the safety device can be mounted easily onto the car.

DESCRIPTION OF EMBODIMENTS

Preferred embodiments of the present invention will now be explained with reference to the drawings.

Embodiment 1

Figure 1:
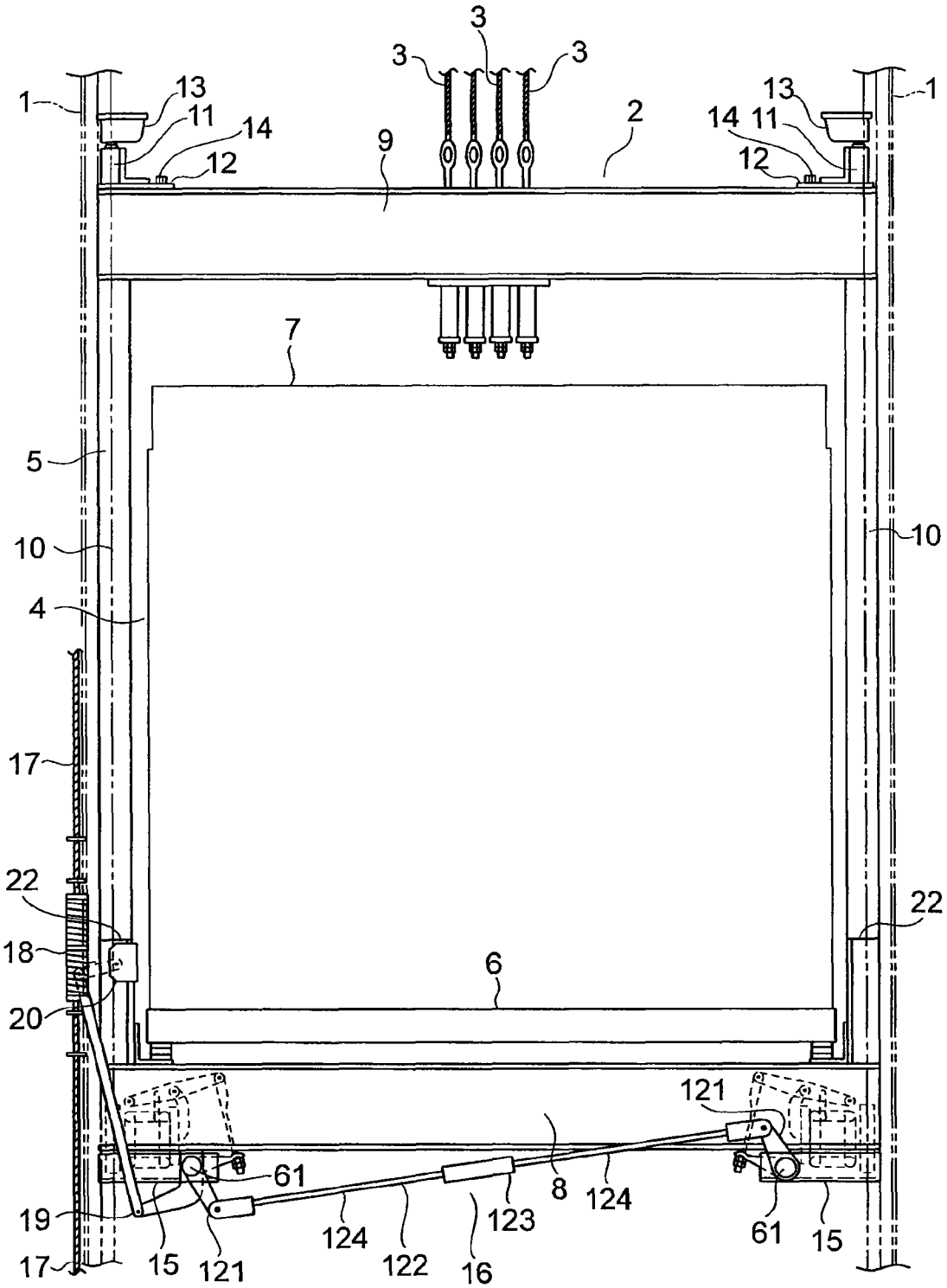
FIG. 1 is a front elevation that shows an elevator car according to Embodiment 1 of the present invention.

FIG. 1 is a front elevation that shows an elevator car according to Embodiment 1 of the present invention. In the figure, a pair of guide rails 1 that face each other in a horizontal direction are disposed vertically inside a hoistway. A car 2 is disposed between the pair of guide rails 1. The car 2 is suspended inside the hoistway by a plurality of suspending bodies 3. Ropes or belts, for example, are used as the suspending bodies 3. The suspending bodies 3 are wound around a driving sheave (not shown) of a hoisting machine (a driving apparatus) that is disposed inside the hoistway. The car 2 is guided by the guide rails 1 while being moved vertically inside the hoistway by the rotation of the driving sheave of the hoisting machine.

The car 2 has: a cage 4; and a car frame 5 that supports the cage 4, and that surrounds the cage 4. The cage 4 has: a car floor 6; and a cage main body 7 that is disposed on the car floor 6. The car frame 5 has: a lower frame 8 that is disposed horizontally, and onto which the cage 4 is mounted so as to have a vibration isolating apparatus interposed; an upper frame 9 that is disposed horizontally above the cage 4; a pair of vertical stanchions 10 that connect respective end portions of the lower frame 8 and the upper frame 9 to each other, and that respectively face the guide rails 1. Each of the suspending bodies 3 is connected to the upper frame 9 by a rope fastening apparatus.

Guide shoes 11 that are guided by the guide rails 1 are respectively fixed by bolts 14 onto an upper surface at two end portions of the upper frame 9 so as to have guide shoe mounting plates 12 interposed. Oilers 13 that supply lubricating oil to the guide rails 1 are respectively disposed on an upper portion of each of the guide shoes 11.

Mounted onto a lower portion of the car frame 5 are: a pair of safety devices 15 that apply a braking force to the car 2 by gripping the pair of guide rails 1 individually; and a coupling apparatus 16 that operates each of the safety devices 15 together by coupling the pair of safety devices 15 to each other.

A speed governor is disposed in an upper portion of the hoistway, and a tensioning sheave is disposed in a lower portion of the hoistway (neither shown). The speed governor has a speed governor sheave (not shown). A speed governor rope 17 is wound around the speed governor sheave and the tensioning sheave. A first end portion and a second end portion of the speed governor rope 17 are connected to each other by means of a rope connecting apparatus 18. The speed governor rope 17 thereby forms a loop shape around the speed governor sheave and the tensioning sheave.

Connected to the rope connecting apparatus 18 are: a safety linking apparatus 19 that is coupled to the safety devices 15; and a car linking apparatus 20 that is coupled to the car frame 5. Thus, when the car 2 moves vertically, the speed governor rope 17 is moved together with the car 2, and the speed governor sheave is rotated in response to the movement of the car 2.

An overspeed switch that is activated when rotational speed of the speed governor sheave reaches a preset set overspeed is disposed on the speed governor. When the overspeed switch is activated, power supply to the hoisting machine that moves the car 2 is stopped, activating the hoisting machine braking apparatus. The speed governor performs an operation to grip the speed governor rope 17 if the rotational speed of the speed governor sheave 15 reaches a safety overspeed that is higher than the set overspeed. Because movement of the speed governor rope 17 is stopped when the speed governor rope 17 is gripped by the speed governor, but movement of the car 2 continues, the car 2 is displaced relative to the speed governor rope 17. The safety linking apparatus 19 is operated by the displacement of the car 2 relative to the speed governor rope 17, activating the safety devices 15. A speed governor operation detecting switch that detects that the speed governor has operated is disposed on the speed governor. Safety operation detecting switches that detect that the safety devices 15 have operated are disposed on the safety devices 15.

Figure 2:
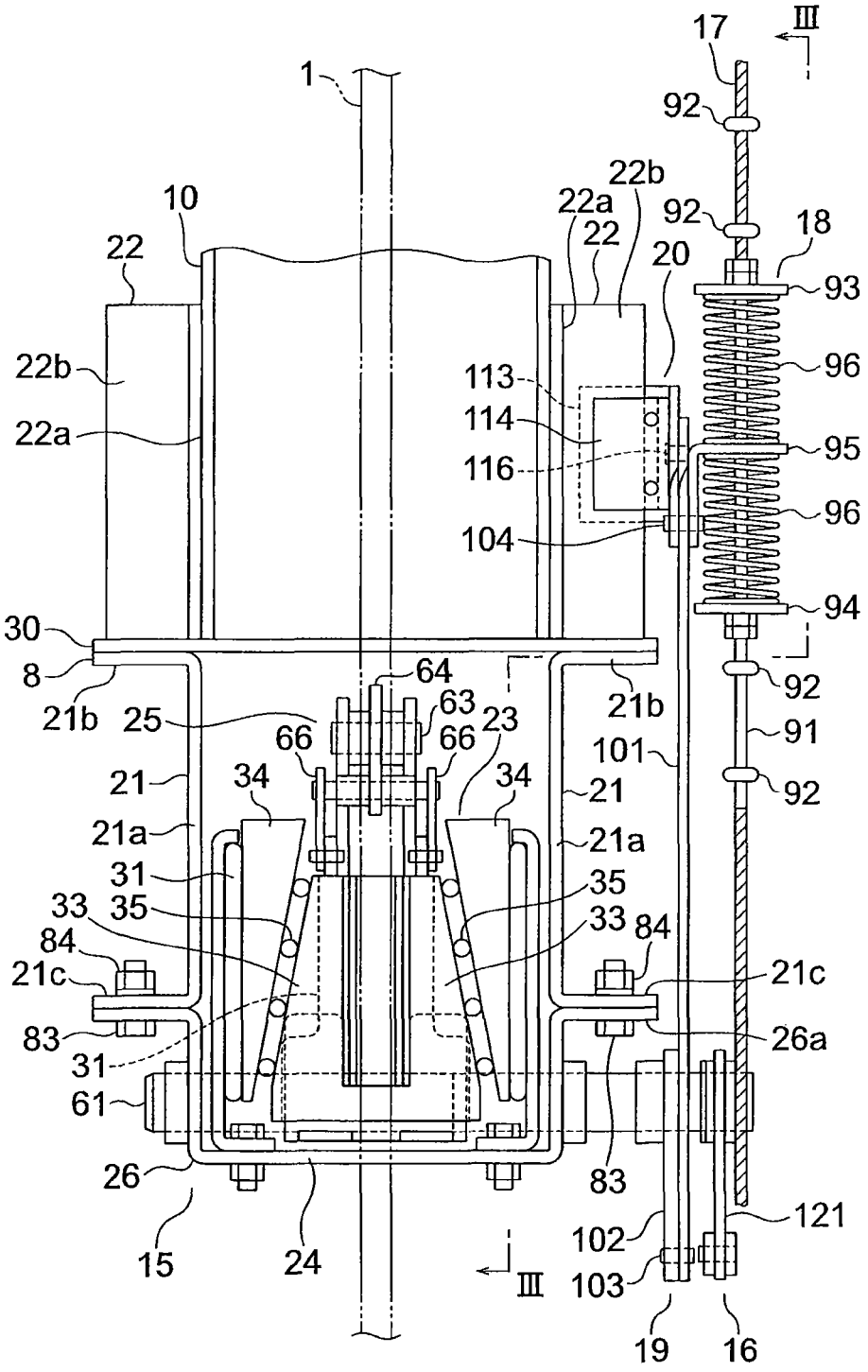
FIG. 2 is a front elevation that shows a safety device from FIG. 1.
Figure 3:
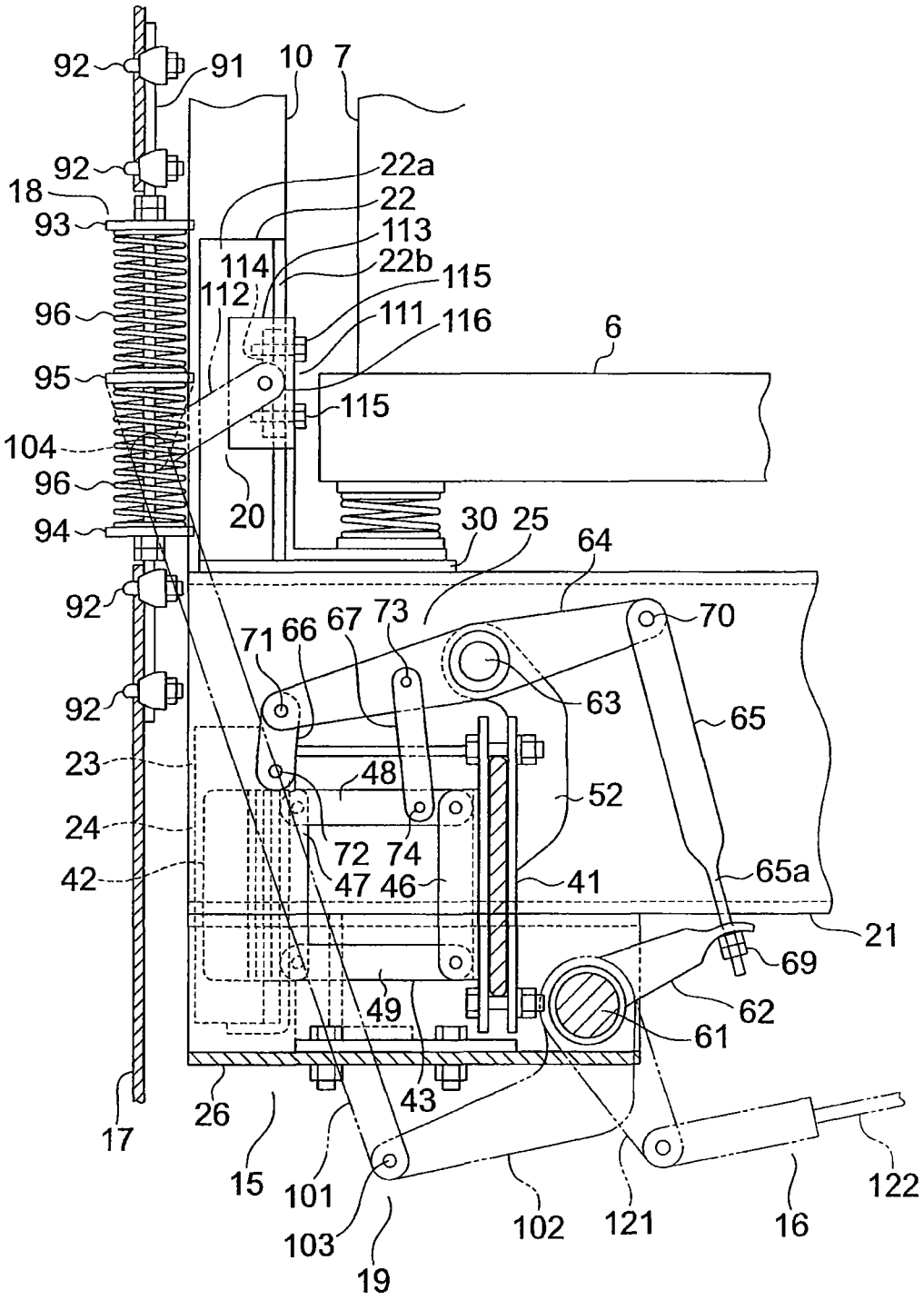
FIG. 3 is a cross section that is taken along Line III-III in FIG. 2.
Figure 4:
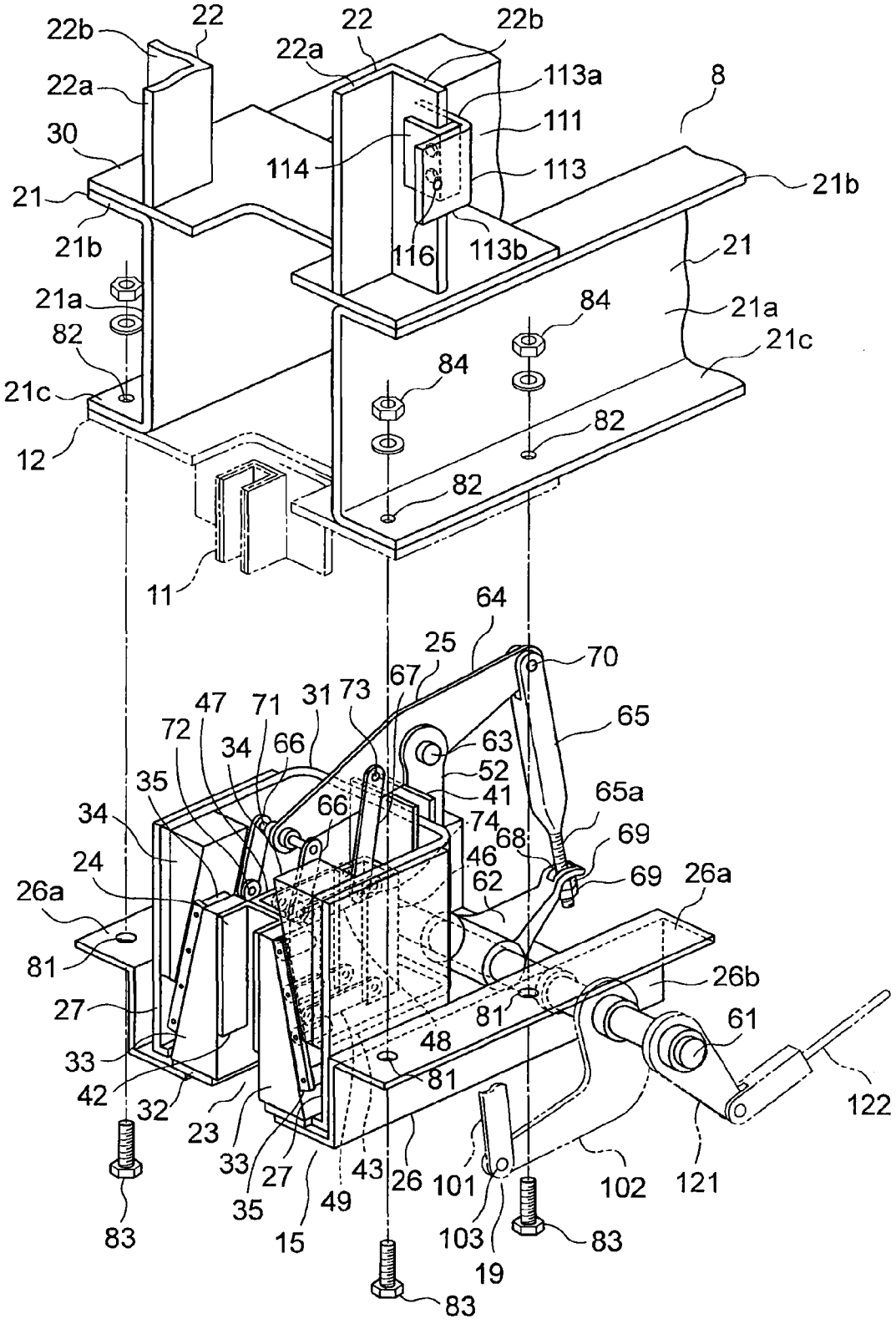
FIG. 4 is an oblique projection that shows a state in which the safety device from FIG. 2 is removed from a lower frame.

FIG. 2 is a front elevation that shows a safety device 15 from FIG. 1, and FIG. 3 is a cross section that is taken along Line III-III in FIG. 2. FIG. 4 is an oblique projection that shows a state in which the safety device 15 from FIG. 2 is removed from the lower frame 8. In the figures, the lower frame 8 has a pair of lower beams 21 that face each other in a width direction of the vertical stanchions 10. Each of the lower beams 21 is a beam that has a U-shaped cross section that has: a vertical plate portion 21*a*; and an upper plate portion 21*b* and a lower plate portion 21*c* that protrude outward horizontally from an upper edge portion and a lower edge portion, respectively, of the vertical plate portion 21*a* so as to face each other vertically. The pair of lower beams 21 are disposed such that the vertical plate portions 21*a* face each other in the width direction of the vertical stanchions 10 and the upper plate portions 21*b* and the lower plate portions 21*c* face outward.

The vertical stanchion 10 is fixed to the lower frame 8 by means of a fixing plate 30 that is disposed on top of each of the lower beams 21 so as to span between the pair of lower beams 21. A pair of vertical stanchion fixing members 22 are fixed to a lower end portion of the vertical stanchion 10 so as to be parallel to the longitudinal direction of the vertical stanchion 10. The vertical stanchion fixing members 22 are members that have L-shaped cross sections that have: fixing plate portions 22*a* that contact side surfaces of the vertical stanchion 10; and protruding plate portions 22*b* that protrude outward from the fixing plate portions 22*a* away from the vertical stanchion 10.

The safety device 15 has: a safety device main body 23 that can grip a guide rail 1; a guiding apparatus 24 that is guided by the guide rail 1; an actuating apparatus 25 that interlocks the safety device main body 23 and the guiding apparatus 24; and a supporting body 26 that supports the safety device main body 23, the guiding apparatus 24, and the actuating apparatus 25 together. The safety device 15 is a safety device with a built-in guiding apparatus.

The supporting body 26 is mounted onto a lower surface of the lower frame 8 from below in a state in which the safety device main body 23, the guiding apparatus 24, and the actuating apparatus 25 are each partially inserted inside the lower frame 8 (into a space between the pair of lower beams 21). The supporting body 26, as shown in FIG. 4 in particular, has: a pair of mounting plate portions (mounting portions) 26*a* that are mounted onto the lower surface of the pair of lower beams 21 individually so as to be disposed apart from each other; and a bearing portion 26*b* that is disposed between the pair of mounting plate portions 26*a*, and on which a cavity is formed that accommodates respective lower portions of the safety device main body 23, the guiding apparatus 24, and the actuating apparatus 25 by protruding below the respective mounting plate portions 26*a*. The safety device main body 23, the guiding apparatus 24, and the actuating apparatus 25 are each disposed higher than a lower surface of the bearing portion 26*b*. A pair of retainers 27 that face each other from opposite sides of the safety device main body 23 are fixed to the bearing portion 26*b* by nuts and bolts. Each of the retainers 27 is a fitting that can be elastically deformed.

The safety device main body 23, as shown in FIG. 4, in particular, has: a U-shaped flat spring (a horseshoe-shaped spring) 31 that constitutes an elastic body that is supported by the pair of retainers 27; a movable base (a movable body) 32 that can be moved vertically relative to the U-shaped flat spring 31 and the supporting body 26; a pair of wedges (braking members) 33 that are disposed on the movable base 32, and that are displaced vertically together with the movable base 32; a pair of guiding members 34 that are disposed on an inner surface of the U-shaped flat spring 31, and that guide each of the wedges 33 in a direction of contact with and separation from the guide rail 1 during vertical displacement of each of the wedges 33; and a sliding apparatus 35 that is interposed between the wedges 33 and the guiding members 34, and that smooths the guiding of the wedges 33 by the guiding members 34.

The pair of guiding members 34 are disposed so as to be separated from the guide rail 1 on two width direction sides of the guide rail 1. An inclined surface that is inclined relative to the guide rail 1 so as to be further away from the guide rail 1 lower down is formed on each of the guiding members 34.

Figure 5:
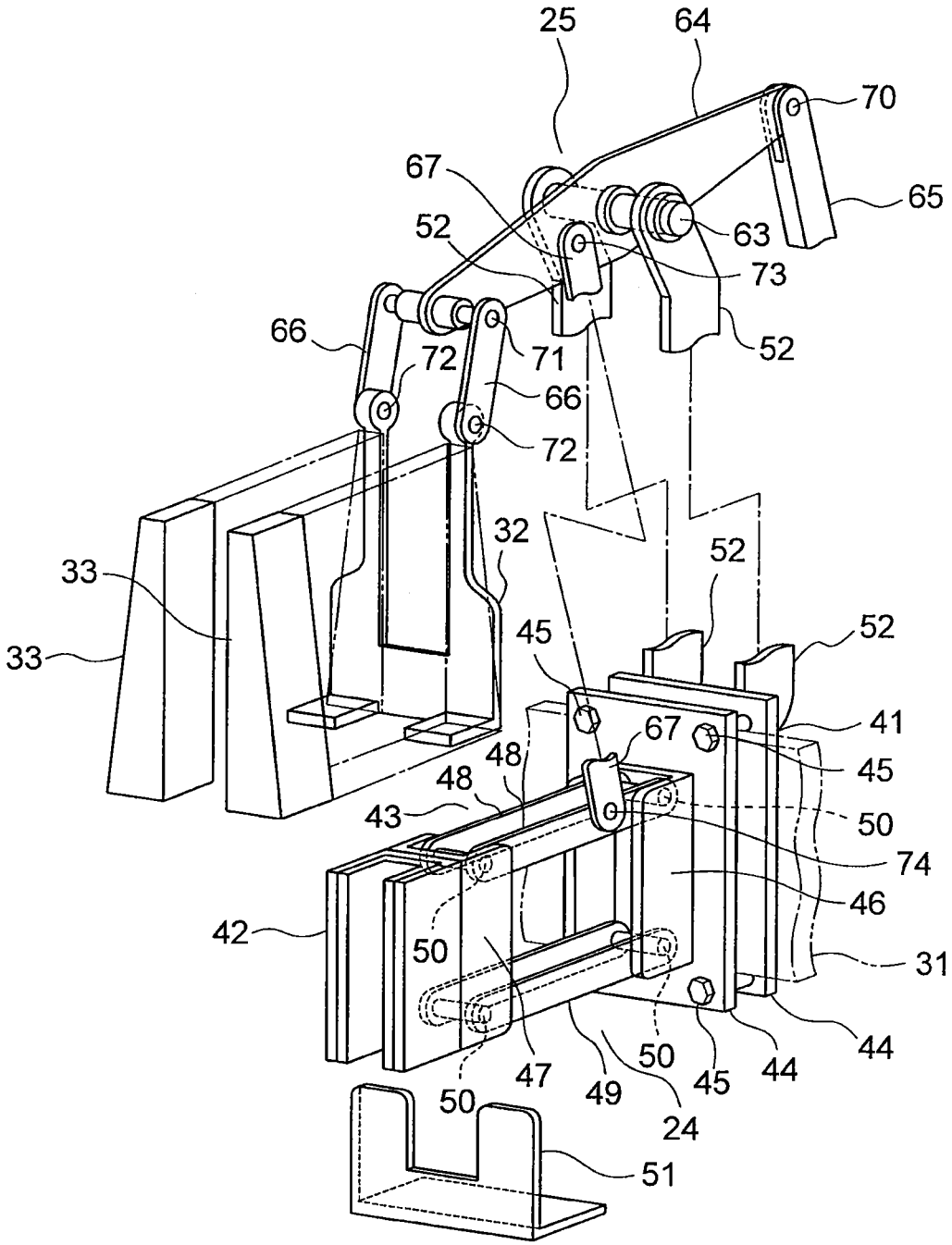
FIG. 5 is an exploded oblique projection that shows a portion of the safety device from FIG. 4.
Figure 6:
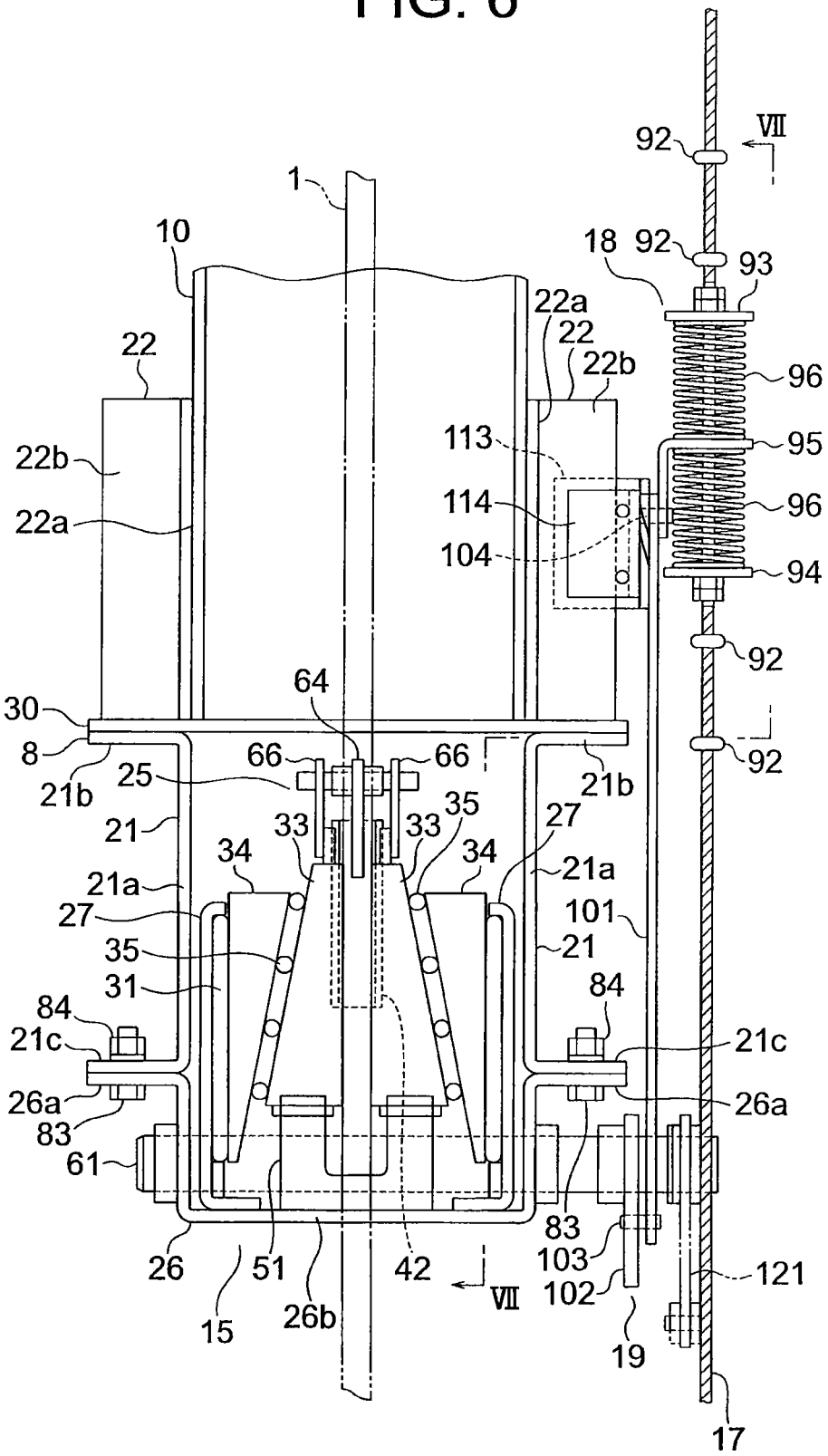
FIG. 6 is a front elevation that shows a state in which the safety device from FIG. 2 is operating.
Figure 7:
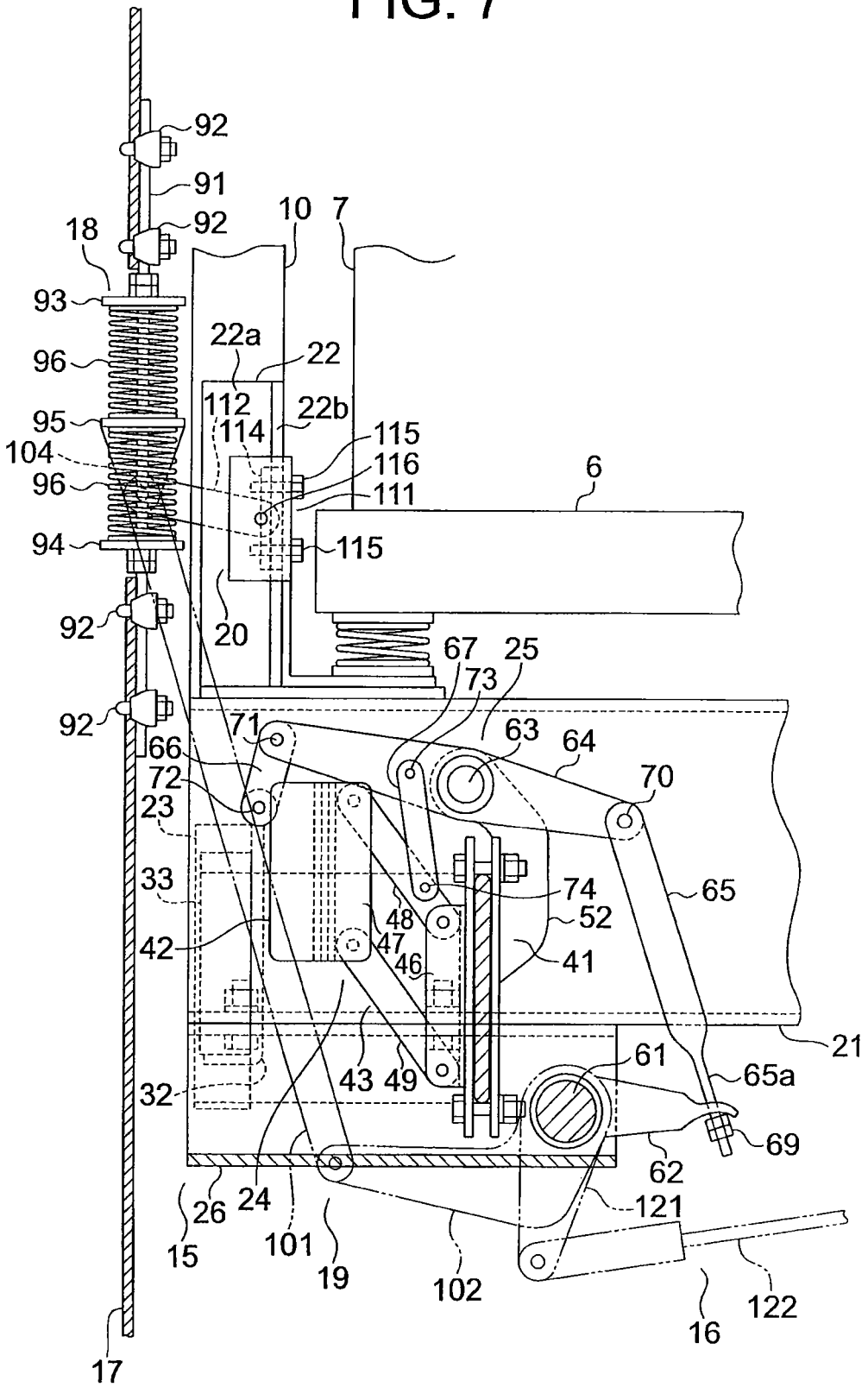
FIG. 7 is a cross section that is taken along Line VII-VII in FIG. 6.

Now, FIG. 5 is an exploded oblique projection that shows a portion of the safety device 15 from FIG. 4. FIG. 6 is a front elevation that shows a state in which the safety device 15 from FIG. 2 is operating, and FIG. 7 is a cross section that is taken along Line VII-VII in FIG. 6.

The wedges 33, as shown in FIG. 5, in particular, are mounted onto a shared movable base 32 so as to be displaceable horizontally. The wedges 33 are disposed on two sides in the width direction of the guide rail 1, and are respectively disposed between the inclined surfaces of the guiding members 34 and the guide rail 1.

The wedges 33 contact the guide rail 1 while being guided by the inclined surfaces of the guiding members 34 by being displaced upward relative to the supporting body 26 together with the movable base 32, and push open gaps between the guide rail 1 and the guiding members 34 by being displaced further upward. The U-shaped flat spring 31 and the retainers 27 are deformed elastically by the gap between the guide rail 1 and the guiding members 34 being pushed open by the wedges 33, generating an elastic force of recovery. The wedges 33 are pressed against the guide rail 1 from two sides by the elastic forces of recovery of the U-shaped flat spring 31 and the retainers 27 so as to grip the guide rail 1. When the guide rail 1 is gripped by the wedges 33, frictional force is generated between the wedges 33 and the guide rail 1, applying a braking force to the car 2. In other words, in this example, the safety device main body 23 is a progressive safety device main body in which the magnitude of the braking force on the car 2 is maintained stably.

A mounting apparatus 41 for mounting the guiding apparatus 24 onto the U-shaped flat spring 31 is mounted onto the U-shaped flat spring 31. The mounting apparatus 41, as shown in FIG. 5, in particular, has: a pair of (first and second) clamping plates 44 that clamp onto the plate of the U-shaped flat spring 31; and a plurality of bolts 45 and a plurality of nuts that tighten the pair of clamping plates 44 toward each other. The mounting apparatus 41 is mounted onto the U-shaped flat spring 31 by tightening the pair of clamping plates 44 that are positioned on opposite sides of the U-shaped flat spring 31 using the nuts and bolts.

The guiding apparatus 24 is mounted onto the mounting apparatus 41. The guiding apparatus 24 is thereby supported on the supporting body 26 by means of the mounting apparatus 41, the U-shaped flat spring 31, and the retainers 27. The guiding apparatus 24 has: a guide shoe 42 that is displaceable relative to the supporting body 26; and a guide shoe linking apparatus 43 is interposed between the guide shoes 42 and the mounting apparatus 41, and that mounts the guide shoes 42 onto the mounting apparatus 41 displaceably. Consequently, the guiding apparatus 24 is a movable guiding apparatus in which the guide shoes 42 displace.

The guide shoe 42 is displaceable between a guided position that is guided by the guide rail 1 inside the safety device main body 23 (FIGS. 2 through 4), and a retracted position that is disengaged from the guided position (FIGS. 6 and 7). When the guide shoe 42 is in the guided position, the guide rail 1 is fitted into a groove that is disposed on the guide shoe 42. When the guide shoe 42 is in the retracted position, the guide shoe 42 separated from the guide rail 1. The guide shoe 42 is displaced to the guided position when each of the wedges 33 is separated from the guide rail 1, and is displaced to the retracted position when each of the wedges 33 contacts the guide rail 1. The guide shoe 42 is inserted into the space between the pair of wedges 33 by displacement to the guided position (FIGS. 2 through 4). The guide shoe 42 is removed from the space between the pair of wedges 33 by displacement to the retracted position (FIGS. 6 and 7).

The guide shoe linking apparatus 43, as shown in FIG. 5, in particular, has: a first anchor fitting 46 that is fixed to the first clamping plates 44 of the mounting apparatus 41; a second anchor fitting 47 that is fixed to the guide shoe 42; a pair of upper portion links 48 that are linked pivotably between upper end portions of the first and second anchor fittings 46 and 47; and a pair of lower portion links 49 that are linked pivotably between lower end portions of the first and second anchor fittings 46 and 47 so as to be parallel to the upper portion links 48. The linking between the upper portion links 48 and each of the first and second anchor fittings 46 and 47, and the linking between the lower portion links 49 and each of the first and second anchor fittings 46 and 47, is performed by respective shafts 50. The guide shoe 42 is displaced between the guided position and the retracted position by being pivoted around the shafts 50 with the upper portion links 48 and the lower portion links 49 held in a parallel state.

A shoe transverse vibration preventing fitting 51 for preventing transverse vibration of the guide shoe 42 is fixed to the bearing portion 26*b* of the supporting body 26. Of the pair of clamping plates 44, the second clamping plate 44 is the clamping plate onto which the guide shoe linking apparatus 43 is not mounted, and a pair of supporting arms 52 that extend upward from the second clamping plate 44 are fixed onto the second clamping plate 44. The supporting arm 52 is disposed above the supporting body 26. As shown in FIGS. 3 and 7, a position of an upper end portion of the supporting arm 52 is a position that is lower than an upper surface of the lower frame 8.

The actuating apparatus 25, as shown in FIG. 4, in particular, has: a pivoting shaft 61 that is rotatably supported horizontally by the supporting body 26; a pivoting lever 62 that is disposed on the pivoting shaft 61 so as to be pivoted together with the pivoting shaft 61; a seesaw body 64 that is pivotable around an upper portion shaft 63 that is disposed on an upper end portion of the supporting arm 52; a connecting rod 65 that interlocks the pivoting lever 62 and the seesaw body 64; a pair of safety interlocking links 66 that interlock the seesaw body 64 and the safety device main body 23; and a guide shoe interlocking link 67 that interlocks the seesaw body 64 and the guiding apparatus 24.

The pivoting shaft 61 is disposed above a lower surface of the bearing portion 26*b* when passed through the bearing portion 26*b* of the supporting body 26. The pivoting shaft 61 is disposed behind the safety device main body 23 and the guiding apparatus 24 when viewed from the guide rail 1.

The seesaw body 64 is a flat member that has a predetermined length. An intermediate portion of the seesaw body 64 is mounted onto the upper portion shaft 63. A first end portion of the seesaw body 64 reaches above the movable base 32, and a second end portion of the seesaw body 64 reaches above the pivoting lever 62.

The connecting rod 65 is connected between the seesaw body 64 and the pivoting lever 62. A first end portion of the connecting rod 65 is pivotably connected to the second end portion of the seesaw body 64 by means of a shaft 70. A penetrating slot 68 is disposed on an end portion of the pivoting lever 62. A screw-threaded rod 65*a* that is inserted into the penetrating slot 68 is disposed on a second end portion of the connecting rod 65. A plurality of nuts 69 that prevent the screw-threaded rod 65*a* from dislodging from the penetrating slot 68 are screwed onto the screw-threaded rod 65*a*. The seesaw body 64 is thereby pivoted around the upper portion shaft 63 in response to the pivoting of the pivoting shaft 61.

The pair of safety interlocking links 66 is connected between the seesaw body 64 and the movable base 32. First end portions of each of the safety interlocking links 66 are pivotably connected to the first end portion of the seesaw body 64 by means of a common shaft 71. Second end portions of each of the safety interlocking links 66 are connected pivotably to an upper end portion of the movable base 32 by means of shafts 72. The movable base 32 and each of the wedges 33 are thereby displaced in response to the pivoting of the seesaw body 64.

The guide shoe interlocking link 67 is connected between the seesaw body 64 and one of the upper portion links 48. A first end portion of the guide shoe interlocking link 67 is pivotably connected to a portion of the seesaw body 64 between the upper portion shaft 63 and the shaft 71 by means of the shaft 73. A second end portion of the guide shoe interlocking link 67 is pivotably connected to an intermediate portion of the upper portion link 48 by means of the shaft 74. The guide shoe linking apparatus 43 and the guide shoe 42 are thereby displaced in response to the pivoting of the seesaw body 64.

The guide shoe 42 is displaced to the guiding position when each of the wedges 33 is in a position that is separated from the guide rail 1 (FIGS. 2 and 3). When the seesaw body 64 is pivoted and each of the wedges 33 is displaced upward, the wedges 33 contact the guide rail 1 under guidance from the guiding members 34, and the guide shoe 42 is also displaced upward and reaches the retracted position while separating from the guide rail 1 (FIGS. 6 and 7). In other words, the actuating apparatus 25 displaces the guide shoe 42 toward the retracted position while displacing each of the wedges 33 in a direction of contact with the guide rail 1 by interlocking the wedges 33 and the guide shoe 42, respectively, in response to the pivoting of the common seesaw body 64.

A plurality of bolt passage apertures (penetrating apertures) 81 are disposed on each of the mounting plate portions 26*a* of the supporting body 26 as shown in FIG. 4. A plurality of existing mounting apertures (penetrating apertures) 82 for mounting the guide shoe mounting plates 12 are previously disposed on the lower plate portion 21*c* of each of the lower beams 21. The respective bolt passage apertures 81 are disposed on the supporting body 26 so as to be aligned with the positions of the respective mounting apertures 82. The supporting body 26 is mounted onto the lower surface of the lower frame 8 by screwing the mounting nuts 84 onto the mounting bolts 83 that have been passed sequentially through the bolt passage apertures 81 and the mounting apertures 82, and tightening the mounting bolts 83 and the mounting nuts 84. In other words, the supporting body 26 is mounted onto the lower frame 8 from below using the mounting apertures 82 that have been previously disposed on the lower frame 8.

The safety device main body 23, the guiding apparatus 24, and the actuating apparatus 25 are housed at a height position in a range that is higher than a lower surface of the supporting body 26 and lower than the upper surface of the lower frame 8.

The rope connecting apparatus 18 has: a rod (a rod-shaped body) 91 that is fastened by a plurality of clips (fastening devices) 92 to the first end portion and the second end portion of the speed governor rope 17; an upper portion backing plate 93 and a lower portion backing plate 94 that are respectively disposed on the rod 91 so as to be separated from each other in a longitudinal direction of the rod 91; an intermediate member 95 that is disposed between the upper portion backing plate 93 and the lower portion backing plate 94 so as to be displaceable in the longitudinal direction of the rod 91; and connecting springs (elastic bodies) 96 that are respectively interposed between the intermediate member 95 and the upper portion backing plate 93 and between the intermediate member 95 and the lower portion backing plate 94. The intermediate member 95 is configured so as to be subjected to elastic forces of recovery from the connecting springs 96 in directions of return to their original positions when displaced relative to the rod 91.

The safety linking apparatus 19 has: a first link 101 that is coupled pivotably to the intermediate member 95 by means of a shaft 104; and a second link 102 that is fixed to the pivoting shaft 61 so as to be coupled pivotably to the first link 101 by means of a shaft 103. The second link 102 is pivoted together with the pivoting shaft 61.

If the car 2 is displaced downward relative to the rope connecting apparatus 18, the safety linking apparatus 19 operates interdependently in response to the displacement of the car 2 relative to the rope connecting apparatus 18 such that the pivoting shaft 61 is pivoted in a direction in which the wedges 33 are displaced upward.

The car linking apparatus 20 has: a car mounting apparatus 111 that is mounted onto a vertical stanchion fixing member 22 by clamping a protruding plate portion 22*c*; and a link 112 that is coupled between the intermediate member 95 and the car mounting apparatus 111.

The car mounting apparatus 111 has: a mounting bracket 113 and a brace 114 that are on opposite sides of the protruding plate portion 22*b*; and a plurality of fastening bolts 115 that fasten the mounting bracket 113 and the brace 114 (FIGS. 3 and 7). As shown in FIG. 4, the mounting bracket 113 has: a backing plate portion 113*a* that is disposed alongside the protruding plate portion 22*b*; and a coupling plate portion 113*b* that is disposed perpendicular to the backing plate portion 113*a*, and to which the link 112 is coupled.

A plurality of bolt passage apertures (penetrating apertures) through which the fastening bolts 115 are passed are disposed on the brace 114. A plurality of screw-threaded apertures into which the fastening bolts 115 are screwed are disposed on the backing plate portion 113*a* of the mounting bracket 113. The mounting bracket 113 and the brace 114 are fastened by screwing the fastening bolts 115 that have been passed through the bolt passage apertures into the screw-threaded apertures of the backing plate portion 113*a* and fastening them. The respective fastening bolts 115 avoid the protruding plate portion 22*b* and fasten the brace 114 and the backing plate portion 113*a*.

A first end portion of the link 112 is coupled pivotably to the intermediate member 95 by means of the shaft 104, and a second end portion of the link 112 is coupled pivotably to the coupling plate portion 113*b* of the mounting device 113 by means of a shaft 116.

As shown in FIG. 1, the coupling apparatus 16 couples together the pivoting shafts 61 of each of the safety devices 15. The coupling apparatus 16 has: a pair of (first and second) pivoting arms 121 that are fixed individually to each of the pivoting shafts 61; and a coupling member 122 that couples together each of the pivoting arms 121.

A first end portion of the coupling member 122 is coupled pivotably to the first pivoting arm 121 by means of a shaft, and a second end portion of the coupling member 122 is coupled pivotably to the second pivoting arm 121 by means of a shaft. The shaft that is disposed on the first end portion of the coupling member 122 and a shaft that is disposed on the second end portion of the coupling member 122 are positioned at mutually opposite ends of a plane that contains the shaft axis of each of the pivoting shafts 61. Thus, when the safety linking apparatus 19 is operated by the displacement of the car 2 relative to the rope connecting apparatus 18, the respective pivoting shafts 61 are pivoted interdependently by the coupling apparatus 16 in opposite directions to each other such that each of the safety devices 15 is operated in synchrony.

The coupling member 122 has: a cylindrical joint member 123 that has an inner surface that is a screw-threaded portion; and a pair of coupling rods 124 that are coupled to each of the pivoting arms 121 individually, and that are screwed into two end portions of the joint members 123. A longitudinal dimension of the coupling member 122 is adjustable by adjusting the amount of thread engagement of each of the coupling rods 124 into the joint member 123.

When a hydraulic direct-coupled plunger-type elevator in which safety devices are not mounted onto a car 2 is remodeled into a suspension elevator such as that described above, in which safety devices 15 are mounted onto the car 2, a hydraulic jack that is directly coupled to the car 2 is removed, and a hoisting machine is installed at a predetermined position inside the hoistway, and the car 2 is suspended using suspending bodies 3 that are wound onto the driving sheave of the hoisting machine. A speed governor and a tensioning sheave are installed inside the hoistway, and a speed governor rope 17 is wound continuously around the speed governor sheave and the tensioning sheave, and then the first end portion and the second end portion of the speed governor rope 17 are connected using the rope connecting apparatus 18. In addition, the safety devices 15 are mounted onto the car 2, and then the safety devices 15 and the rope connecting apparatus 18 are coupled using the safety linking apparatus 19, and the car frame 5 and the rope connecting apparatus 18 are coupled using the car linking apparatus 20.

Figure 8:
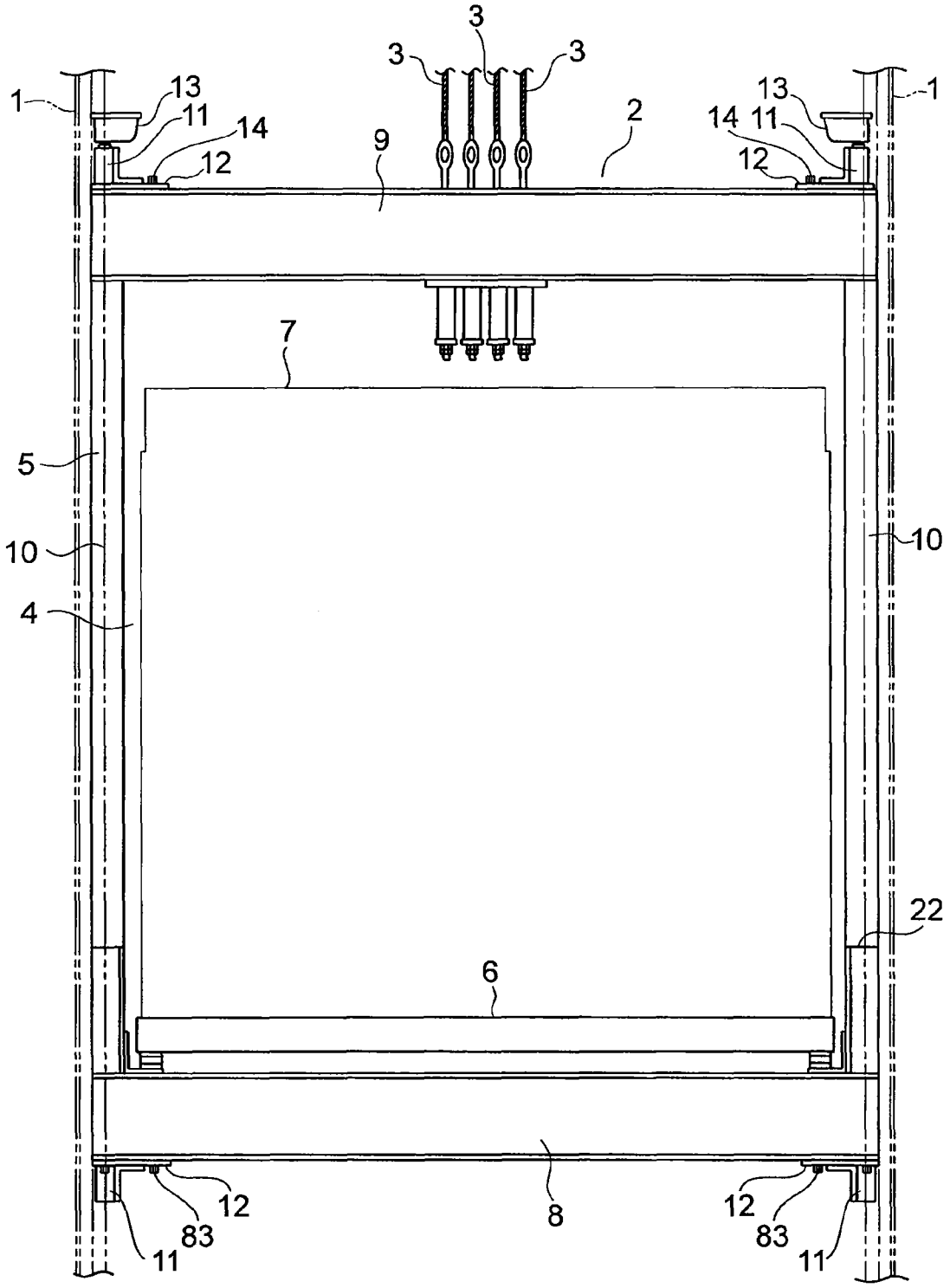
FIG. 8 is a front elevation that shows a state before mounting safety devices to the car in FIG. 1.
Figure 9:
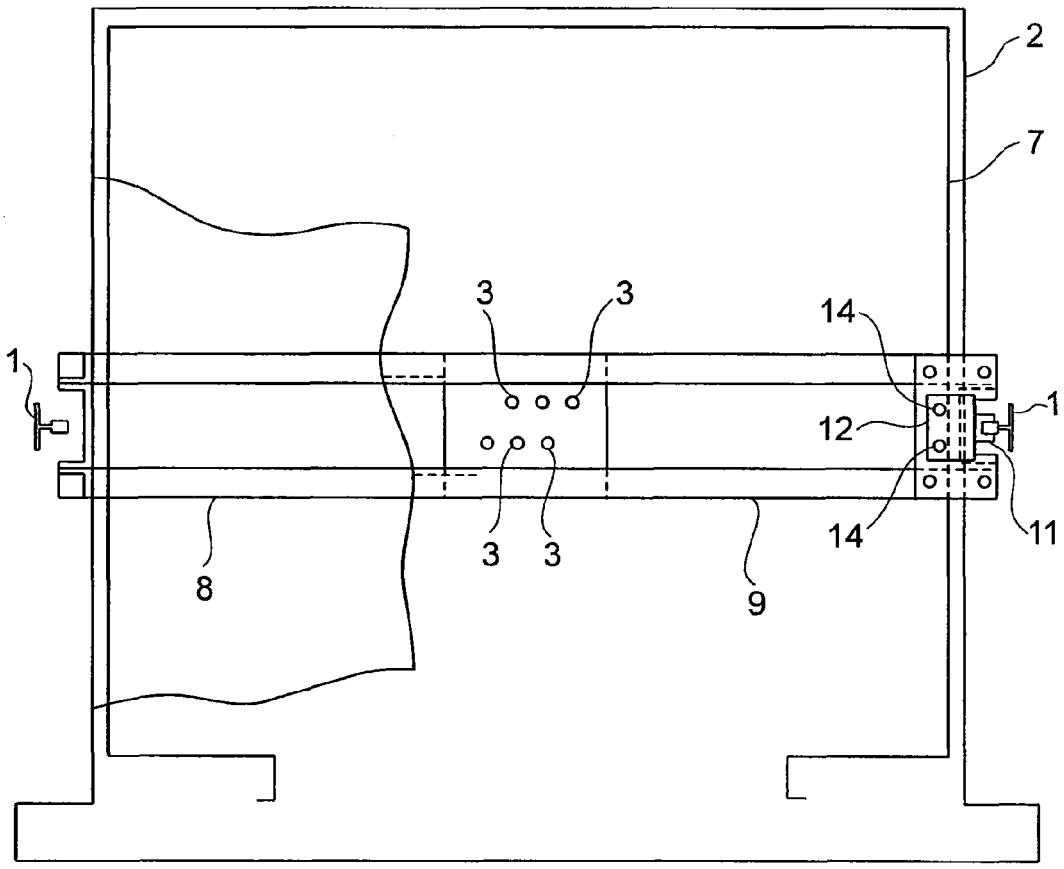
FIG. 9 is a partially cut-away top plan that shows the car from FIG. 8.

Next, a method for mounting the safety devices 15 onto the car 2 will be explained. FIG. 8 is a front elevation that shows a state before mounting the safety devices 15 to the car 2 in FIG. 1. FIG. 9 is a partially cut-away top plan that shows the car 2 from FIG. 8. In a state before the safety devices 15 are mounted onto the car 2, guide shoes 11 are respectively mounted by means of the guide shoe mounting plates 12 not only onto the upper surface at two end portions of the upper frame 9, but also onto a lower surface at two end portions of the lower frame 8. The guide shoe mounting plates 12 are mounted onto the lower surface of the lower frame 8 by the mounting bolts 83 and the mounting nuts 84 using the mounting apertures 82 (FIG. 4) that are previously disposed on the lower frame 8.

When the safety devices 15 are to be mounted onto the car 2, safety units are first produced by mounting the safety device main bodies 23, the guiding apparatuses 24, and the actuating apparatuses 25 together onto the supporting bodies 26. At this point, the safety device main bodies 23, the guiding apparatuses 24, and the actuating apparatuses 25 are mounted onto the supporting bodies 26 so as to be disposed higher than the lower surfaces of the supporting bodies 26. Furthermore, at this point the second link 102 and the pivoting arms 121 are also fixed onto the pivoting shafts 61 of the actuating apparatuses 25 at a predetermined angle (a unit producing step).

Figure 10:
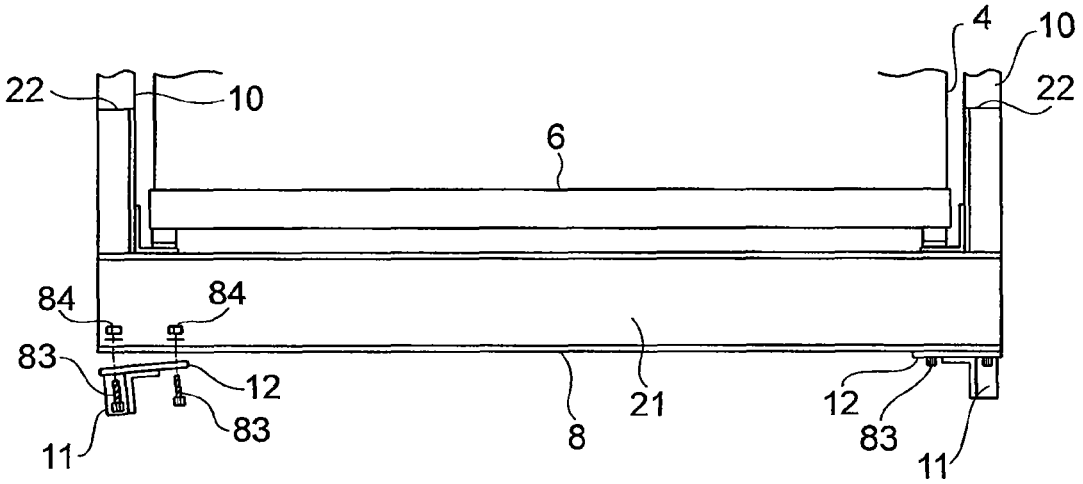
FIG. 10 is a front elevation that shows a state of a lower portion of the car when a guide shoe mounting plate and a guide shoe from FIG. 8 are removed from the lower frame.

The guide shoe mounting plates 12 that are mounted onto the lower surface of the lower frame 8 are removed from the lower frame 8 together with the guide shoes 11. Now, FIG. 10 is a front elevation that shows a state of a lower portion of the car 2 when a guide shoe mounting plate 12 and a guide shoe 11 from FIG. 8 are removed from the lower frame 8. As shown in FIG. 10, the guide shoe mounting plates 12 and the guide shoes 11 are removed from the lower frame 8 by removing the mounting bolts 83 and the mounting nuts 84 (a guide shoe mounting plate removing step).

Figure 11:
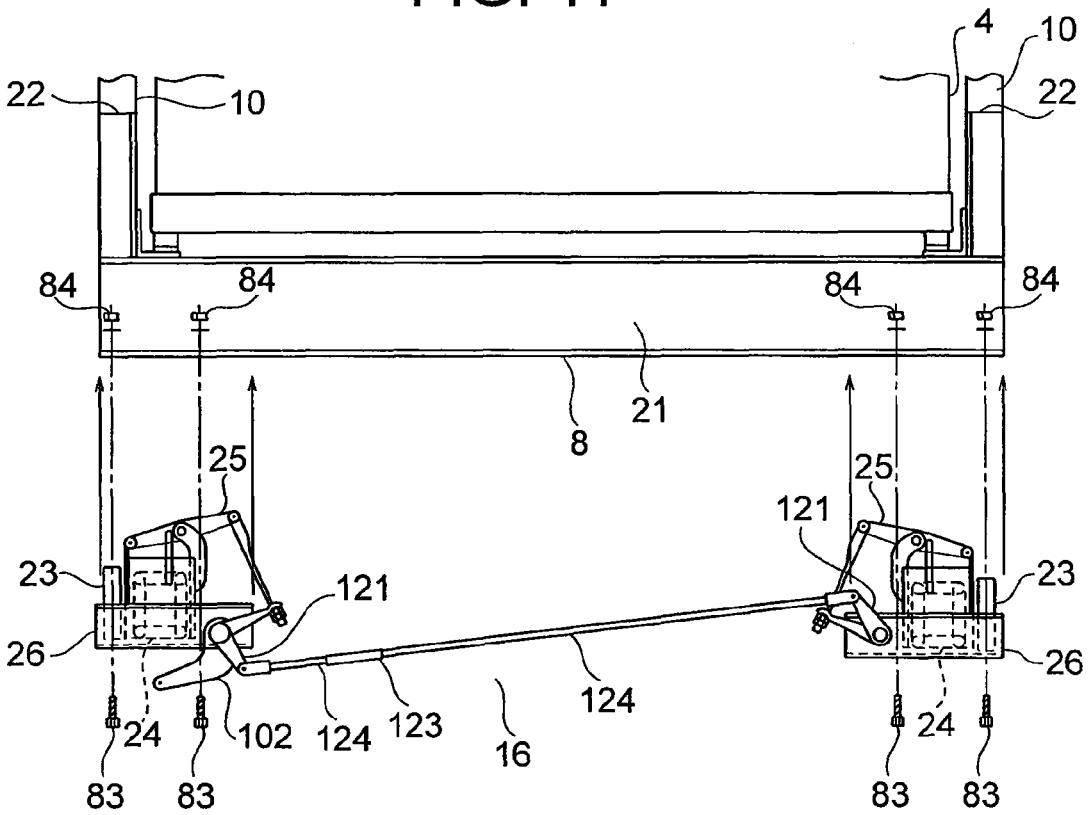
FIG. 11 is a front elevation that shows a state of the lower portion of the car when mounting safety units onto the lower frame from FIG. 10.

Next, the respective safety units are mounted onto the two end portions of the lower frame 8. Now, FIG. 11 is a front elevation that shows a state of the lower portion of the car 2 when mounting the safety units onto the lower frame 8 from FIG. 10. As shown in FIG. 11, each of the safety units is mounted onto the lower frame 8 by mounting the supporting body 26 onto the lower frame 8 from below by inserting an upper portion (a portion) of the safety unit inside the lower frame 8 from below. The supporting body 26 is mounted onto the lower frame 8 by the mounting bolts 83 and the mounting nuts 84 using the mounting apertures 82 on the lower frame 8. The mounting bolts 83 and the mounting nuts 84 that attached the guide shoe mounting plates 12 onto the lower frame 8 are reused as the mounting bolts 83 and the mounting nuts 84 (a unit mounting step).

The safety devices 15 are thereby mounted onto the car 2.

Next, as described above, the speed governor and the tensioning sheave are installed inside the hoistway, and the first end portion and the second end portion of a speed governor rope 17 that is wound continuously around the speed governor sheave and the tensioning sheave are connected using the rope connecting apparatus 18.

Next, the backing plate portion 113*a* and the brace 114 are fastened using the plurality of fastening bolts 115 such that the protruding plate portion 22*b* of the vertical stanchion fixing member 22 is sandwiched between the backing plate portion 113*a* of the mounting bracket 113 and the brace 114. The car mounting apparatus 111 is thereby mounted onto the car frame 5 (a car mounting apparatus mounting step).

Next, the first link 101 is coupled between the intermediate member 95 of the rope connecting apparatus 18 and the second link 102, and the link 112 is also coupled between the intermediate member 95 and the mounting device 114.

The pair of safety devices 15 are mounted onto the car 2, and then the coupling member 122 is coupled between each of the pivoting arms 121 that are fixed to the pair of (first and second) pivoting shafts 61 that are mounted left and right. In addition, equipment relating to the safety devices 15 is installed by wiring between switches such as an overspeed switch that is disposed on the speed governor, a speed governor operation detecting switch, safety operation detecting switches that are disposed on the safety devices 15, etc., and the controlling board, and performing adjustment of the speed governor, for example.

Next, operation will be explained. When the car 2 is moved, the speed governor rope 17 is moved together with the car 2, thereby moving the speed governor sheave in response to the movement of the car 2. During normal operation, the guide shoes 42 are displaced to the guiding position with each of the wedges 33 separated from the guide rails 1. Consequently, during normal operation the guide shoes 42 are guided by the guide rails 1 in a state in which the braking forces from the safety device main bodies 23 are released.

If the descent speed of the car 2 rises for any reason and reaches a set overspeed that is preset, an overspeed switch that is disposed on the speed governor is activated. Thus, power supply to the hoisting machine that moves the car 2 is stopped, activating the hoisting machine braking apparatus.

If the descent speed of the car 2 rises further after the power supply to the hoisting machine is stopped and reaches a safety overspeed that is higher than the set overspeed, the speed governor is activated and the speed governor rope 17 is gripped by the speed governor. Thus, movement of the speed governor rope 17 stops, and the car 2 is displaced downward relative to the rope connecting apparatus 18.

If the car 2 is displaced downward relative to the rope connecting apparatus 18, the first pivoting shaft 61 is pivoted by means of the safety linking apparatus 19. Here, the second pivoting shaft 61 is also pivoted interdependently with the first pivoting shaft 61 by the coupling apparatus 16. When the pivoting shaft 61 is pivoted, the wedges 33 and the guide shoes 42 are all pulled upward. The guide shoes 42 are thereby displaced to the retracted position that is outside the spaces between the pairs of wedges 33, and the guide rails 1 are gripped by the pairs of wedges 33 due to the wedges 33 contacting the guide rails 1 under guidance from the guiding members 34. Thus, a braking force is generated on the car 2, making the car 2 perform an emergency stop.

In an elevator safety device 15 of this kind, because the safety device main bodies 23, the guiding apparatuses 24, and the actuating apparatuses 25 are supported together on the supporting bodies 26, and the supporting bodies 26 are mounted onto the lower frame 8 from below using the mounting apertures 82 that are previously disposed on the lower frame 8, the supporting bodies 26 can be mounted onto the lower frame 8 without machining the lower frame 8. The supporting bodies 26 can be mounted onto the lower frame 8 with the safety device main bodies 23, the guiding apparatuses 24, and the actuating apparatuses 25 premounted onto the supporting bodies 26. The safety devices 15 can thereby be mounted onto the car 2 easily. Consequently, the installation work period for the safety devices 15 can be shortened, enabling shortening of down time during which the elevator cannot be used to be achieved. Because respective portions of the safety device main bodies 23, the guiding apparatuses 24, and the actuating apparatuses 25 are inserted inside the lower frame 8, the safety devices 15 can be prevented from protruding downward significantly (vertically) from the car 2. Thus, the safety devices 15 can be mounted to the car 2 even if there is not sufficient room in the pit of the hoistway, for example. In addition, because the guide shoes 42 are displaceable between a guided position and a retracted position, the guide shoes 42 can be disposed inside the safety device main bodies 23 when the wedges 33 are separated from the guide rails 1. Thus, it is no longer necessary to dispose the safety device main bodies 23 and the guiding apparatuses 24 so as to line up vertically, enabling reductions in height dimensions of the safety devices 15 to be achieved. The distance between the guide shoes 11 and the guide shoes 42 that are disposed on upper portions of the car 2 can be lengthened compared to when the guide shoes 42 are fixed above the safety device main bodies 23, enabling the car 2 to be moved more stably.

In the actuating apparatuses 25, because the seesaw bodies 64 are pivoted around the upper portion shafts 63 that are disposed above the supporting bodies 26 in response to the pivoting of the pivoting shafts 61 and the pivoting levers 62, and the safety interlocking links 66 that displace the wedges 33 in response to the pivoting of the seesaw bodies 64 and the guide shoe interlocking links 67 that displace the guide shoes 42 in response to the pivoting of the seesaw bodies 64 are connected to the seesaw bodies 64, the height dimensions of the actuating apparatuses 25 that pull up the respective wedges 33 and the guide shoes 42 can be reduced by disposing the seesaw bodies 64 horizontally. The ratios of the portions of the safety device main bodies 23, the guiding apparatuses 24, and the actuating apparatuses 25 that are inserted inside the lower frame 8 can thereby be enlarged. Thus, the dimensions of the portions of the safety devices 15 that protrude downward from the car 2 can be further reduced.

Because the cavities that accommodate the lower portions of the safety device main bodies 23 are formed on the bearing portions 26*b* of the supporting bodies 26 by protruding below the pair of mounting plate portions 26*a*, the safety device main bodies 23, the guiding apparatuses 24, and the actuating apparatuses 25 can be easily mounted on top of the supporting bodies 26. Even if the height dimensions of the safety device main bodies 23, the guiding apparatuses 24, and the actuating apparatuses 25 are larger than the height dimensions of the lower frame 8, portions of the safety device main bodies 23, the guiding apparatuses 24 and the actuating apparatuses 25 that protrude downward from inside the lower frame 8 can be borne by the bearing portions 26*b*. The safety devices 15 can thereby be mounted onto the car 2 even if they are too large for the safety device main bodies 23, the guiding apparatuses 24, and the actuating apparatuses 25 to be inserted completely inside the lower frame 8.

In a method for mounting a safety device 15 of this kind, because the safety units are produced by mounting the safety device main bodies 23, the guiding apparatuses 24, and the actuating apparatuses 25 together onto the supporting bodies 26, and then the supporting bodies 26 are mounted onto the lower frame 8 from below using the mounting apertures 82 that are previously disposed on the lower frame 8 while inserting portions of the safety units inside the lower frame 8 from below, the safety devices 15 can be mounted onto the car 2 easily without machining the lower frame 8. Because the portions of the safety units are inserted inside the lower frame 8, the safety devices 15 can be prevented from protruding significantly downward (vertically) from the car 2.

Embodiment 2

In Embodiment 1, progressive safety device main bodies that stably maintain a magnitude of braking force on the car 2 are supported by the supporting bodies 26, but instantaneous safety device main bodies that stop the car 2 almost instantaneously by generating a braking force on the car 2 rapidly may be supported by the supporting bodies 26.

Figure 12:
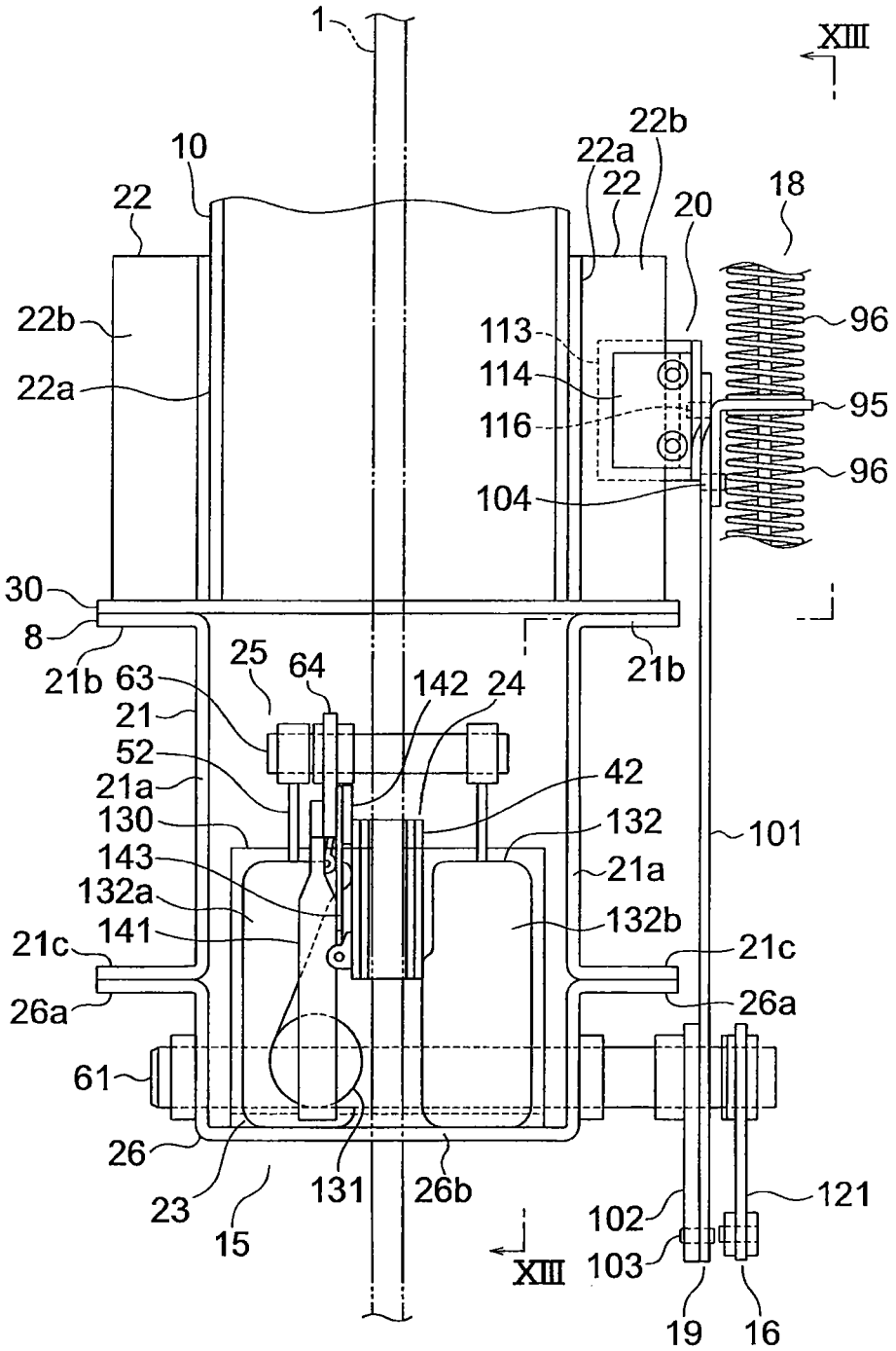
FIG. 12 is a side elevation that shows a safety device that is disposed on a lower portion of a car frame according to Embodiment 2 of the present invention.
Figure 13:
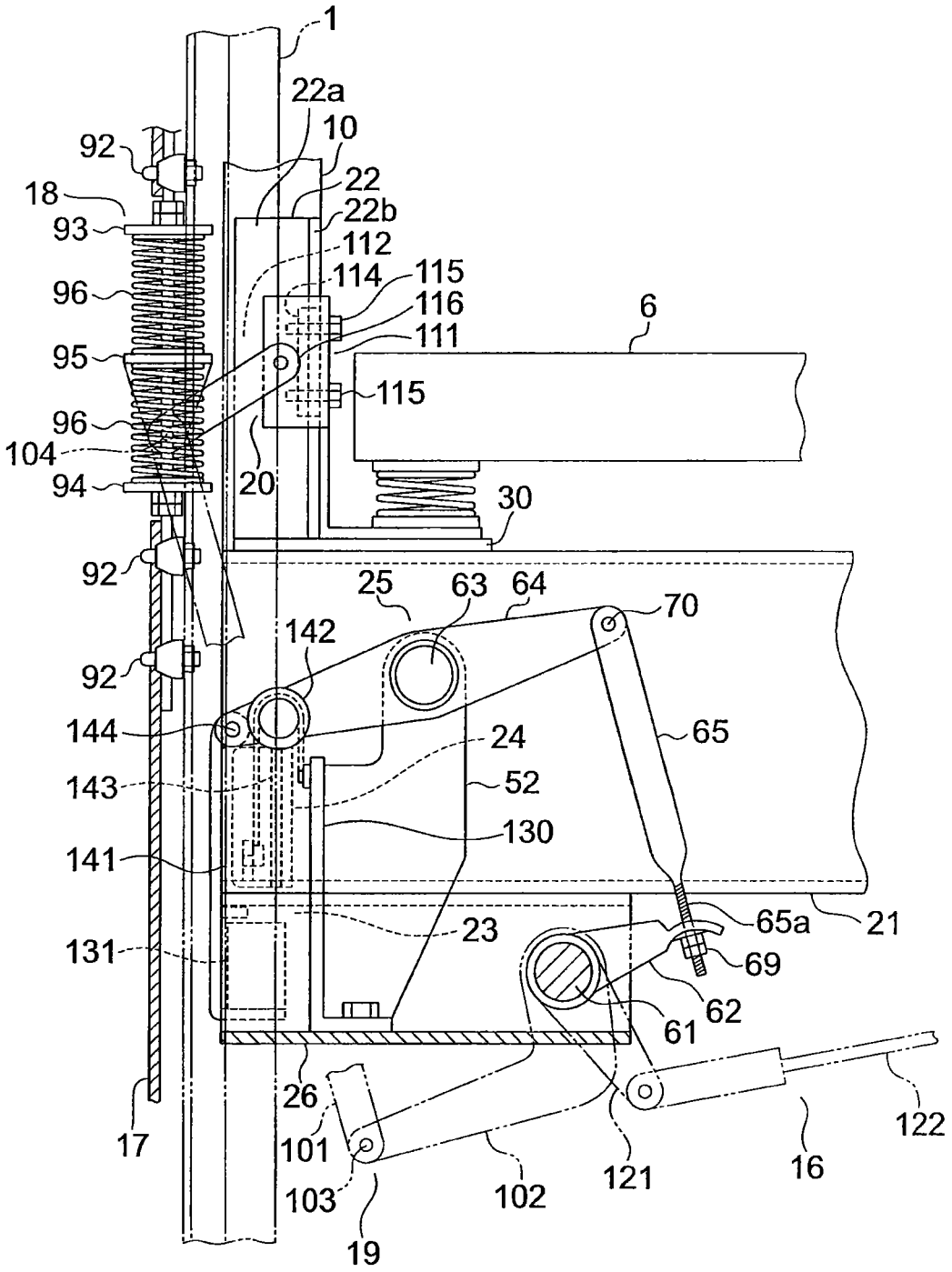
FIG. 13 is a cross section that is taken along Line XIII-XIII in FIG. 12.
Figure 14:
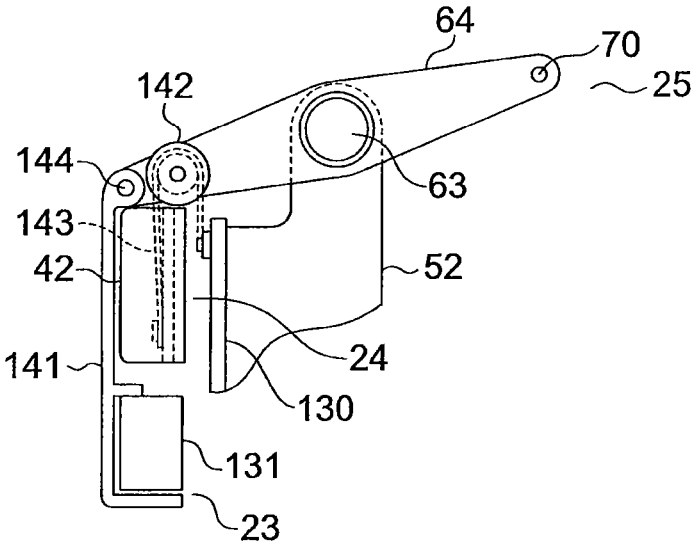
FIG. 14 is a side elevation that shows a portion of the safety device from FIG. 13.
Figure 15:
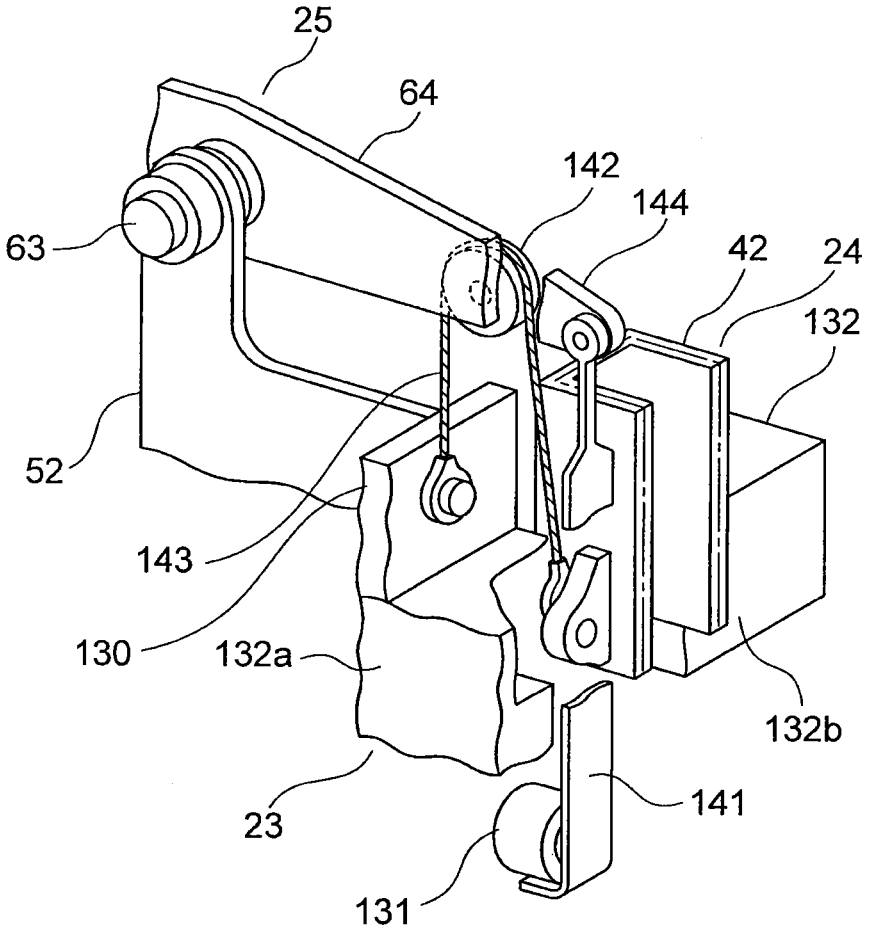
FIG. 15 is an oblique projection that shows a portion of the safety device from FIG. 13.

Specifically, FIG. 12 is a side elevation that shows a safety device 15 that is disposed on a lower portion of a car frame 5 according to Embodiment 2 of the present invention. FIG. 13 is a cross section that is taken along Line XIII-XIII in FIG. 12. In addition, FIG. 14 is a side elevation that shows a portion of the safety device 15 from FIG. 13, and FIG. 15 is an oblique projection that shows a portion of the safety device 15 from FIG. 13.

A supporting fitting 130 is fixed by bolts onto a bearing portion 26*b* of a supporting body 26. A supporting arm 52 on an upper end portion of which an upper portion shaft 63 is disposed is fixed to the supporting fitting 130.

A safety device main body 23 has: a vertically displaceable roller (a braking member) 131; and a gripper (a guiding member) 132 that is disposed on the supporting fitting 130 so as to guide the roller 131 in a direction of contact with and separation from a guide rail 1 by the vertical displacement of the roller 131.

The gripper 132 has a guiding portion 132*a* and a rail contacting portion 132*b* that are each fixed to the supporting fitting 130 so as to be disposed on two sides in a width direction of the guide rail 1. The guide rail 1 is passed through a space between the guiding portion 132*a* and the rail contacting portion 132*b*. A surface of the guiding portion 132*a* near the rail contacting portion 132*b* is an inclined surface that is inclined relative to the guide rail 1 in a direction that is further away from the guide rail 1 lower down. A surface of the rail contacting portion 132*b* near the guiding portion 132*a* is a vertical surface that is parallel to the guide rail 1.

Figure 16:
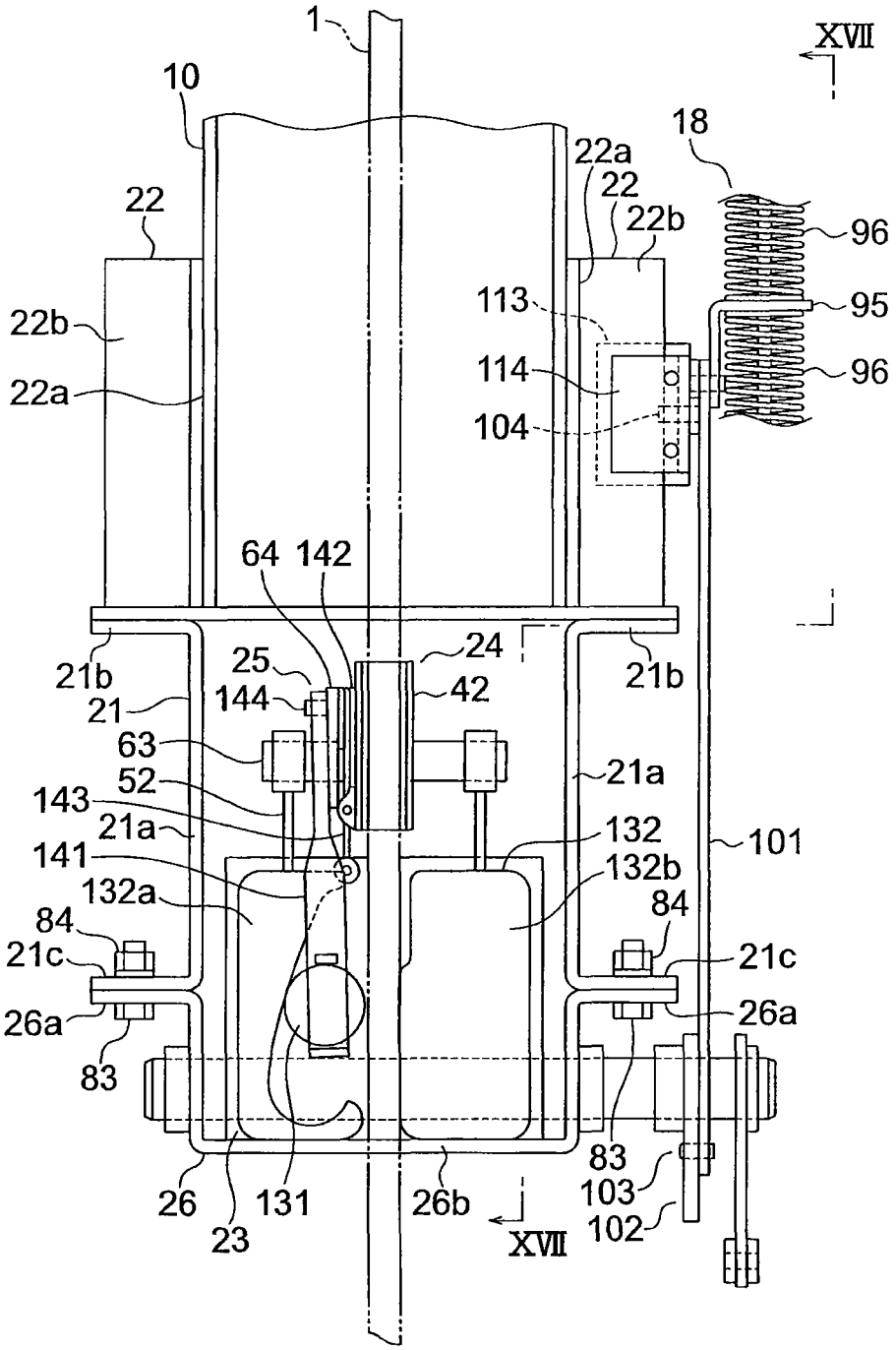
FIG. 16 is a front elevation that shows a state in which the safety device from FIG. 13 is operating.
Figure 17:
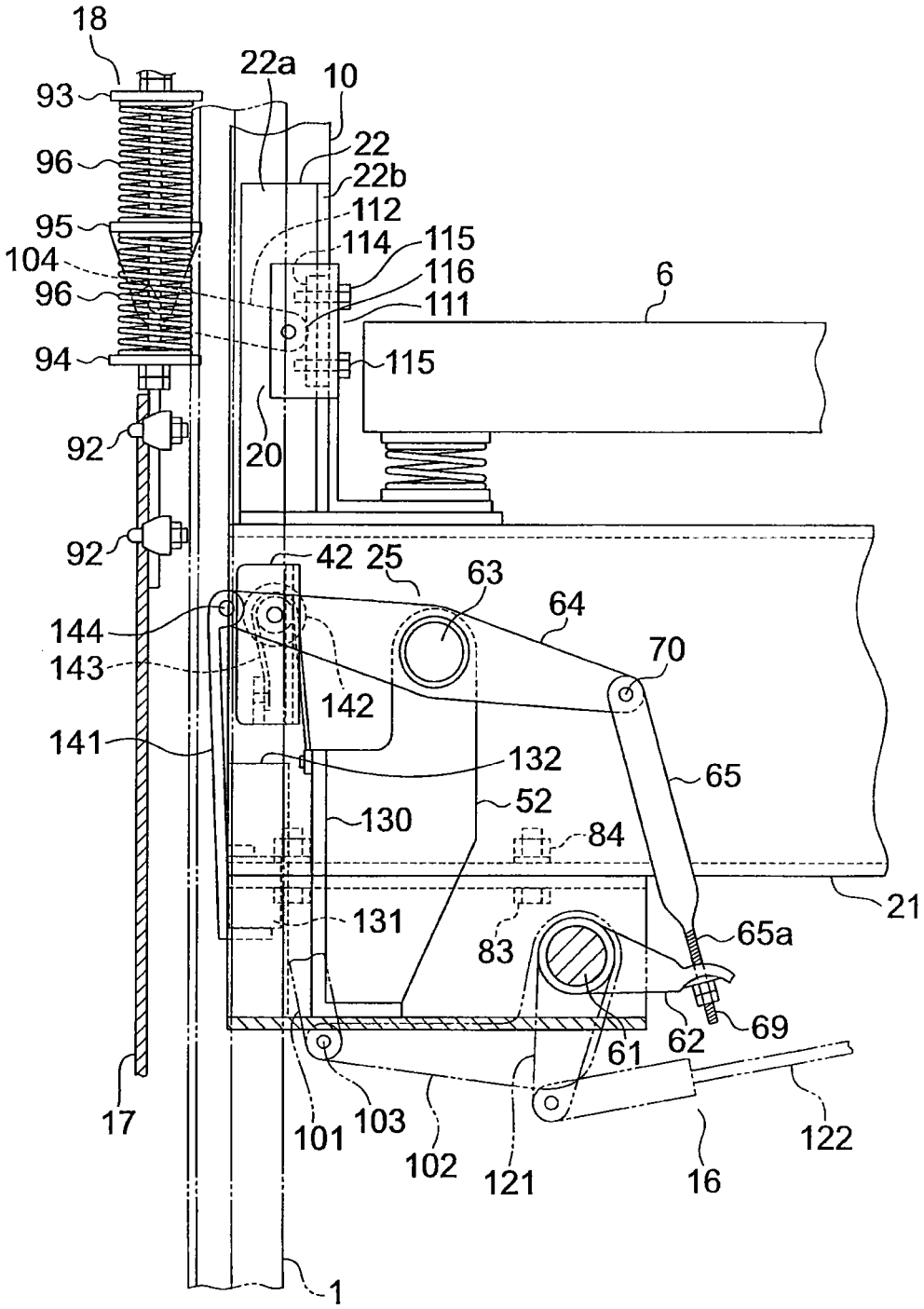
FIG. 17 is a cross section that is taken along Line XVII-XVII in FIG. 16.
Figure 18:
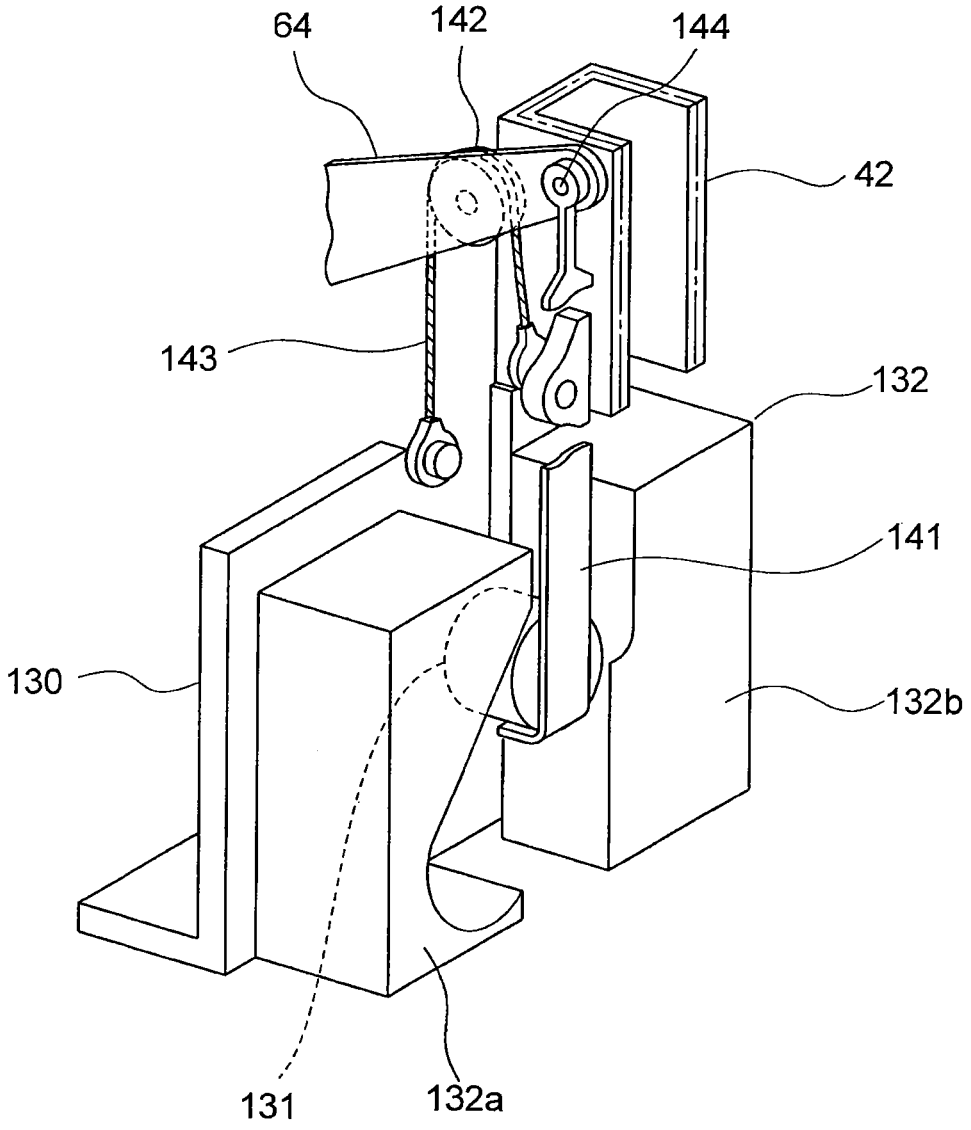
FIG. 18 is an oblique projection that shows a portion of the safety device from FIG. 16.

Now, FIG. 16 is a front elevation that shows a state in which the safety device 15 from FIG. 13 is operating, and FIG. 17 is a cross section that is taken along Line XVII-XVII in FIG. 16. FIG. 18 is an oblique projection that shows a portion of the safety device 15 from FIG. 16.

The roller 131 is guided by the inclined surface of the guiding member 132*a* by being displaced upward relative to the supporting body 26 and contacts the guide rail 1, and pushes open the gap between the inclined surface of the guiding member 132*a* and the guide rail 1 by being displaced further upward. The gripper 132 is thereby displaced together with the supporting body 26 in the width direction relative to the guide rail 1 such that the rail contacting portion 132*b* contacts the guide rail 1, and the roller 131 wedges between the guiding portion 132*a* and the guide rail 1. The guide rail 1 is thereby gripped between the rail contacting portion 132*b* and the roller 131. Thus, when the guide rail 1 is gripped between the rail contacting portion 132*b* and the roller 131, frictional force is generated between the roller 131 and the guide rail 1, and between the rail contacting portion 132*b* and the guide rail 1, rapidly applying a braking force to the car 2. Using this construction, the safety device main bodies 23 are instantaneous safety device main bodies in which the braking force on the car 2 is generated rapidly.

A guiding apparatus 24 has a guide shoe 42 that is displaceable between a guided position that is guided by the guide rail 1 inside the safety device main body 23 (FIGS. 12 through 15), and a retracted position that is disengaged upward from the guided position (FIGS. 16 through 18). When in the guided position, the guide shoe 42 is disposed in a space between the guiding portion 132*a* and the rail contacting portion 132*b*. When in the retracted position, the guide shoe 42 is disposed higher than an upper surface of the gripper 132.

The actuating apparatus 25 has: a pivoting shaft 61 that is disposed on the supporting body 26; a pivoting lever 62 that is disposed on the pivoting shaft 61 so as to be pivoted together with the pivoting shaft 61; a seesaw body 64 that is pivotable around an upper portion shaft 63 that is disposed on the upper end portion of the supporting arm 52; a connecting rod 65 that interlocks the pivoting lever 62 and the seesaw body 64; a safety interlocking link 141 that interlocks the seesaw body 64 and the safety device main body 23; a pulley 142 that is disposed on the seesaw body 64; and a cord-like body 143 that is wound around the pulley 142, and that interlocks the seesaw body 64 and the guide shoe 42. The pivoting shaft 61, the pivoting lever 62, the seesaw body 64, and the connecting rod 65 have similar or identical configurations to those in Embodiment 1.

An upper end portion of the safety interlocking link 141 is pivotably connected to a first end portion of the seesaw body 64 by means of a common shaft 144. The roller 131 is rotatably mounted onto a lower end portion of the safety interlocking link 141. The roller 131 is thereby displaced in response to the pivoting of the seesaw body 64.

The pulley 142 is rotatably disposed on a portion of the seesaw body 64 between the upper portion shaft 63 and the shaft 144. A first end portion of the cord-like body 143 is connected to the guide shoe 42, and a second end portion of the cord-like body 143 is connected to an upper portion of the supporting fitting 130. The guide shoe 42 is thereby suspended by the cord-like body 143 so as to be displaced in response to the pivoting of the seesaw body 64. A wire or a rope, for example, is used as the cord-like body 143.

The guide shoe 42 is displaced to the guiding position when the roller 131 is in a position that is separated from the guide rail 1 (FIGS. 12 through 15). When the seesaw body 64 is pivoted and the roller 131 is displaced upward, the roller 131 contacts the guide rail 1 under guidance from the guiding portion 132*a*, and the guide shoe 42 is also displaced upward along the guide rail 1 and reaches the retracted position (FIGS. 16 through 18). In other words, the actuating apparatus 25 displaces the guide shoe 42 toward the retracted position while displacing the roller 131 in a direction of contact with the guide rail 1 by interlocking the roller 131 and the guide shoe 42, respectively, in response to the pivoting of the common seesaw body 64. The rest of the configuration is similar or identical to that of Embodiment 1.

Thus, even if the instantaneous safety device main bodies 23 that grip the guide rails 1 between the rail contacting portions 132*b* of the grippers 132 and the rollers 131 are supported by the supporting bodies 26, similar effects to those in Embodiment 1 can be achieved such as preventing significant vertical protrusion from the car 2 and enabling easy mounting onto the car 2.

Moreover, in this example, the configuration is such that the cord-like body 143 that is wound around the pulley 142 suspends the guide shoe 42 so as to displace the guide shoe 42 vertically, but the configuration may be such that a guiding apparatuses 24 that is similar or identical to that of Embodiment 1 is disposed on the supporting body 26, and a guide shoe interlocking link 67 that is similar or identical to that of Embodiment 1 is connected between the seesaw body 64 and the guiding apparatus 24 to interlock the guide shoes 42 and the seesaw body 64.

In each of the above embodiments, the safety devices 15 are mounted onto the car 2 during elevator remodeling work, but the safety devices 15 may also be mounted onto the car 2 in a newly installed elevator.

The invention claimed is:

1. An elevator safety device that is mounted onto a car, the car including a cage and a car frame that surrounds the cage, the car being movable along a guide rail, the elevator safety device comprising:

a safety device main body that includes a braking member, the braking member being movable between a first position where the braking member is in contact with the guide rail and a second position where the braking member is separate from the guide rail, the braking member being inserted inside a lower frame of the car frame so as to apply a braking force to the car by placing the braking member in contact with the guide rail;

a guiding apparatus that includes a guide shoe that is displaceable inside the safety device main body, the guide shoe being movable between a guided position where the guide shoe slidably engages the guide rail and a retracted position where the guide shoe is disengaged from the guide rail, the guide shoe being disposed in the guided position when the braking member is separated from the guide rail;

an actuating apparatus that mechanically couples the guide shoe and the braking member such that when the guide shoe is moved from the guided position toward the retracted position, the braking member is moved from the second position toward the first position; and a supporting body that is mounted onto the lower frame using a mounting aperture on the lower frame so as to support the safety device main body, the guiding apparatus, and the actuating apparatus, the supporting body forming a cavity protruding from the lower frame in a direction away from the cage, and the cavity accommodating a portion of the safety device main body, wherein the actuating apparatus comprises a pivoting shaft that is pivotably disposed on the supporting body in the cavity, and the actuating apparatus is configured to displace the guide shoe and the braking member in response to pivoting movement about the pivoting shaft.

2. The elevator safety device according to claim 1, wherein the actuating apparatus further comprises:

a pivoting lever that is pivoted together with the pivoting shaft;

a seesaw body that is pivoted around an upper portion shaft in response to the pivoting of the pivoting lever, the upper portion shaft being disposed between the cage and the supporting body;

a safety interlocking link that is connected to the seesaw body so as to displace the braking member in response to the pivoting of the seesaw body; and a guide shoe interlocking link that is connected to the seesaw body so as to displace the guide shoe in response to the pivoting of the seesaw body.

3. The elevator safety device according to claim 2, wherein the supporting body comprises:

a pair of mounting portions that are mounted onto respective mounting surfaces of the lower frame so as to be separated from each other; and a bearing portion that is disposed between the pair of mounting portions and protruding from the mounting portions along the direction away from the cage to form the cavity.

4. The elevator safety device according to claim 1, wherein the actuating apparatus further comprises:

a pivoting lever that is pivoted together with the pivoting shaft;

a seesaw body that is pivoted around an upper portion shaft in response to the pivoting of the pivoting lever, the upper portion shaft being disposed between the cage and the supporting body;

a safety interlocking link that is connected to the seesaw body so as to displace the braking member in response to the pivoting of the seesaw body;

a pulley that is disposed on the seesaw body; and a cord-like body that is wound around the pulley, and that suspends the guide shoe so as to displace the guide shoe in response to the pivoting of the seesaw body.

5. The elevator safety device according to claim 4, wherein the supporting body comprises:

a pair of mounting portions that are mounted onto respective mounting surfaces of the lower frame so as to be separated from each other; and a bearing portion that is disposed between the pair of mounting portions and protruding from the mounting portions along the direction away from the cage to form the cavity.

6. The elevator safety device according to claim 1, wherein the supporting body comprises:

a pair of mounting portions that are mounted onto respective mounting surfaces of the lower frame so as to be separated from each other; and a bearing portion that is disposed between the pair of mounting portions and protruding from the mounting portions along the direction away from the cage to form the cavity.

* * * * *